US009585427B2

(12) United States Patent
Shapiro et al.

(10) Patent No.: US 9,585,427 B2
(45) **Date of Patent: *Mar. 7, 2017**

(54) SWEAT DIVERTER

(71) Applicant: Rosecroft Components, Inc., San Francisco, CA (US)

(72) Inventors: James Shapiro, San Francisco, CA (US); Don Godfrey, El Cajon, CA (US); Neil Sheehan, Atherton, CA (US)

(73) Assignee: Rosecroft Components, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/677,799

(22) Filed: Apr. 2, 2015

(65) Prior Publication Data

US 2015/0208742 A1 Jul. 30, 2015

Related U.S. Application Data

(63) Continuation of application No. 14/486,746, filed on Sep. 15, 2014, now Pat. No. 9,009,869.

(Continued)

(51) Int. Cl.
*A41D 20/00* (2006.01)
*A41D 31/00* (2006.01)

(52) U.S. Cl.
CPC ..... *A41D 20/00* (2013.01); *A41D 31/00* (2013.01)

(58) Field of Classification Search
CPC .. A42C 5/00; A42C 5/02; A41D 20/00; A41D 31/00

(Continued)

(56) References Cited

U.S. PATENT DOCUMENTS 1,392,539 A 10/1921 Tipograph
1,496,285 A 6/1924 Arond (Continued)

FOREIGN PATENT DOCUMENTS

WO WO-2005/025350 A1 3/2005
WO WO-2011/046988 A2 4/2011

(Continued)

OTHER PUBLICATIONS

International Search Report mailed on Feb. 26, 2013 for PCT Patent Application No. PCT/US2012/059549, filed on Oct. 10, 2012, four pages.

(Continued)

*Primary Examiner* — Gloria Hale
(74) *Attorney, Agent, or Firm* — Cooley LLP

(57) ABSTRACT

Described herein are sweat-diverting devices which can be adhered to a wearer by an adhesive. The sweat-diverting devices described here may be adhered over a portion of the face without circumscribing the head. Such sweat-diverting devices may comprise a first leg and a second leg that are joined at a base of the device to form a channel therebetween, where at least a portion of the base is more rigid than the first and second legs such that an acute angle between the first and second legs is maintained when the sweat-diverting device is applied on a wearer's forehead. In some variations, the thickness of the base is greater than the thickness of either of the legs, which may help to maintain a separation between the tips of the legs even when the sweat-diverting device is applied to a wearer's forehead.

18 Claims, 34 Drawing Sheets

Related U.S. Application Data

(60) Provisional application No. 61/921,302, filed on Dec. 27, 2013.

(58) Field of Classification Search
USPC .... 2/181, 181.2, 181.4, 181.6, 181.8, 182.8, 2/174, 170, 171, 182.2, 182.3, 185.2, 2/182.6, 182.7, 171.3, 10, 7, 11, 15; 132/212
See application file for complete search history.

(56) References Cited

U.S. PATENT DOCUMENTS

| | | | | |
|---|---|---|---|---|
| 1,612,267 | A | 12/1926 | Dickson | |
| 2,331,545 | A | 10/1943 | Gano, Jr. | |
| 4,021,859 | A | 5/1977 | Burke | |
| 4,258,437 | A | 3/1981 | Sawatsky | |
| 4,547,903 | A | 10/1985 | Brown et al. | |
| 4,626,247 | A | 12/1986 | Frankel | |
| 4,638,512 | A | 1/1987 | Frankel | |
| 4,856,116 | A | 8/1989 | Sullivan | |
| 5,129,103 | A | 7/1992 | Gruneisen | |
| 5,146,630 | A | 9/1992 | Richard | |
| 5,740,556 | A | 4/1998 | Brown | |
| 5,781,932 | A | 7/1998 | Brown | |
| 5,926,849 | A | 7/1999 | Boyle | |
| 6,026,518 | A | 2/2000 | Brown | |
| 6,108,818 | A | 8/2000 | Eisenberg | |
| 6,332,225 | B1 | 12/2001 | Casey | |
| 6,353,936 | B2 | 3/2002 | Flatt | |
| 6,567,991 | B1 | 5/2003 | Holslag et al. | |
| 6,584,984 | B2 | 7/2003 | Kelly | |
| 6,971,122 | B2 | 12/2005 | Sanchez | |
| 7,398,559 | B2 | 7/2008 | Flatt | |
| 7,681,252 | B1 | 3/2010 | Petry | |
| 8,296,866 | B2 | 10/2012 | Kelly | |
| 9,009,869 | B1 * | 4/2015 | Shapiro | A41D 20/00 2/181 |
| 2001/0047536 | A1 | 12/2001 | Flatt | |
| 2003/0041365 | A1 | 3/2003 | Sanchez | |
| 2006/0010568 | A1 | 1/2006 | Wiles | |
| 2007/0079423 | A1 | 4/2007 | Flatt | |
| 2008/0086792 | A1 | 4/2008 | Kuracina et al. | |
| 2009/0077716 | A1 | 3/2009 | Farney | |
| 2010/0107306 | A1 | 5/2010 | Kuracina et al. | |
| 2012/0036613 | A1 | 2/2012 | Calon et al. | |
| 2012/0216332 | A1 | 8/2012 | Wooley | |
| 2012/0312445 | A1 | 12/2012 | Kuracina et al. | |
| 2013/0005552 | A1 | 1/2013 | Kuracina et al. | |
| 2013/0097765 | A1 | 4/2013 | Kuracina et al. | |
| 2014/0289932 | A1 * | 10/2014 | Shapiro | A41D 20/00 2/181 |
| 2015/0143615 | A1 | 5/2015 | LePage | |
| 2015/0208742 | A1 * | 7/2015 | Shapiro | A41D 31/00 2/171 |

FOREIGN PATENT DOCUMENTS

| | | | |
|---|---|---|---|
| WO | WO-2011/046988 | A3 | 4/2011 |
| WO | WO-2013/055787 | A1 | 4/2013 |
| WO | WO-2013/159197 | A1 | 10/2013 |
| WO | WO-2015/099848 | A1 | 7/2015 |

OTHER PUBLICATIONS

International Search Report mailed on Mar. 2, 2015, for PCT Patent Application No. PCT/US2014/055650, filed on Sep. 15, 2014, four pages.
Written Opinion of the International Searching Authority mailed on Feb. 26, 2013 for PCT Patent Application No. PCT/US2012/059549, filed on Oct. 10, 2012, five pages.
Written Opinion of the International Searching Authority mailed on Mar. 2, 2015, for PCT Patent Application No. PCT/US2014/055650, filed on Sep. 15, 2014, five pages.
Australian Office Action mailed on May 15, 2015, for Australian Patent Application No. 2012323265, filed on Oct. 10, 2012, 2 pages.
Australian Office Action mailed on Apr. 1, 2016, for Australian Patent Application No. 2012323265, filed on Oct. 10, 2012, 3 pages.
Australian Office Action mailed on Apr. 26, 2016, for Australian Patent Application No. 2012323265, filed on Oct. 10, 2012, 6 pages.
Extended European Search Report mailed on Dec. 17, 2015, for EP Application No. 12 839 785.8, filed on Oct. 10, 2012, 10 pages.
European Communication mailed on Nov. 17, 2016, for EP Application No. 12 839 785.8, filed on Oct. 10, 2012, 4 pages.
Final Office Action mailed on Feb. 6, 2015, for U.S. Appl. No. 14/486,746, filed Sep. 15, 2014, 7 pages.
Non-Final Office Action mailed on Jan. 2, 2015, for U.S. Appl. No. 14/486,746, filed Sep. 15, 2014, 9 pages.
Non-Final Office Action mailed on May 10, 2016, for U.S. Appl. No. 14/351,442, filed Apr. 11, 2014, 10 pages.
Notice of Allowance mailed on Mar. 17, 2015, for U.S. Appl. No. 14/486,746, filed Sep. 15, 2014, 5 pages.
Notice of Acceptance mailed on May 12, 2016, for Australian Patent Application No. 2012323265, filed on Oct. 10, 2012, 2 pages.
Notice of Allowance mailed on Nov. 22, 2016, for U.S. Appl. No. 14/351,442, filed Apr. 11, 2014, 5 pages.
Partial Supplementary European Search Report mailed on Aug. 31, 2015, for EP Application No. 12 839 785.8, filed on Oct. 10, 2012, 5 pages.

* cited by examiner section A-A section B-B

CUTS

FOLD

SWEAT DIVERTER

CROSS REFERENCE TO RELATED APPLICATIONS

This application is a continuation of U.S. patent application Ser. No. 14/486,746, filed Sep. 15, 2014, now U.S. Pat. No. 9,009,869, which claims priority to U.S. Provisional Patent Application Ser. No. 61/921,302, filed on Dec. 27, 2013, the contents of which are hereby incorporated by reference herein in their entirety.

BACKGROUND

When undertaking an activity causing sweating, a person can suffer from the effects of sweat dripping into his eyes. Many devices have been developed to address this problem, such as absorbent sweatbands. Such devices fail to prevent sweat from reaching the eyes once they become saturated, and must be dried or wrung out in order to restore their effectiveness. Other types of sweat headbands, e.g., sweat-diverting headbands, have also been developed in order to address the problem of sweatband saturation and resultant inability to prevent additional sweat from reaching the eyes. These other types of sweat headbands, to remain effective, must be remain in tight apposition to the forehead, which may require an uncomfortably tight fit of the headband around the wearer's head. Accordingly, improved devices for addressing problems caused by sweat may be desirable.

BRIEF SUMMARY

Described herein are sweat-diverting devices which may be affixed to a wearer by an adhesive, such as a pressure-sensitive adhesive. A sweat-diverting device that does not circumscribe the head may comprise one or more curves that conform to the facial features of the wearer, and/or may comprise one or more reinforcing members and/or thickened or stiffened segments to help maintain the shape of the device. In one variation, a sweat-diverting device may comprise a first leg and a second leg that are joined at a base of the device to form a channel, where at least a portion of the base is more rigid than the first and second legs such that an acute angle between the first and second legs is maintained when the sweat-diverting device is applied on a wearer's head. For example, at least a portion of the base may be thicker than the first and second legs. Alternatively or additionally, at least a portion of the base may be made of a material that is more rigid than the material of the legs. The juncture of the legs at the base of the device may be thicker than a tip portion of the legs such that a space between the first and second legs (e.g., the tips of the first and second legs) is maintained when the sweat-diverting device is applied on a wearer's forehead.

A sweat-diverting device may be reusable two or more times, with a reusable adhesive or an adhesive reapplied for each wearing, or may be single use and disposable, in either case with the adhesive integrated with the device during manufacturing or applied before use by the wearer. The device may assume a variety of shapes, including but not limited to a linear and/or curved shape (e.g., a combination of linear and curved contours). The device may also be discontinuous and used in pairs, for example, for use over each eye. It may also be configured to be worn at various heights on the forehead, over or under the brow line. In some variations, the sweat-diverting device may be adhered over a portion of the face without circumscribing the head.

One variation of a wearable sweat-diverting device may comprise legs defining a channel with an adhesive backing, where the adhesive is protected or covered by a release liner until the device is ready to be applied to the wearer's forehead. The device may be long enough so that, when applied to the wearer's forehead, it may span both eyes, such that sweat, when diverted from dripping from the forehead toward the eyes, exits the device laterally displaced from the wearer's eyes. Such a device may be affixed to the forehead so that the highest point of the device, relative to the vertical dimension of the forehead, is generally centered over the eyes (e.g., at the horizontal center of the forehead). Sweat captured in the channel will then flow downward and outward in the channel to its termination, where it flows down the side of the wearer's face. Such a configuration may allow the device to be placed closer to the eyes than a circumferentially fitting sweat-diverting headband, since the device is not required to follow a substantially linear path (in contrast to a headband). Further, use of the adhesive as the attachment mechanism may render it more comfortable to wear than a circumferentially fitted sweat-diverting headband, which must be worn tightly enough to maintain apposition of the sweat capturing channel to the forehead.

Another variation of a wearable sweat-diverting device may be specifically configured to fit between the eyebrows and the eyes, for example, in the orbital region of the eyes. Such a device may have a shape bias to fit over the bridge of the nose and along the orbital portion of the face until terminating laterally displaced from the eyes. Such a variation may also comprise a channel with a single use adhesive backing, covered by a protective liner until ready for use.

Another variation of a wearable sweat-diverting device may comprise a pair of separate adhesive backed, channels configured to fit over the individual eyes of the wearer. Such a device may assume a curved shape, such that the center of each is affixed to the forehead above the eyebrows, with the lateral side extending past the eye and the medial side extending to the nose. Sweat captured in the channel may flow out of the device on the lateral side down the wearer's face laterally displaced from the eye, and on the medial side down the nose and medially displaced form the eye. The medial end of such a variation may also be long enough, and/or shaped, to terminate above, at or below the level of the eye so that sweat from skin in those areas may also be prevented from reaching the eyes. Such an arrangement may be beneficial since in windy conditions, or conditions such as during bike riding where rapid forward movement would create a breeze directed at the wearer's face, sweat produced at or even below eye level might otherwise reach the eyes.

Another variation of a wearable sweat-diverting device may be configured similarly to the description in the immediately preceding paragraph, but shaped and sized for placement completely below the eyebrows. In such a variation, the device may be positioned to have a greater catchment area than devices placed a greater distance from the eyes.

The channels of the sweat-diverters described herein may have any suitable cross-sectional geometry. They may be generally U-shaped, generally V-shaped, or the like. In addition, the legs of the diverter that form the channel may or may not be the same length, and may or may not terminate at the same height. In addition, the space between the legs may be varied to provide a larger or smaller channel.

In other variations, the cross-section of a sweat-diverting channel may have curves designed to perform multiple functions. For example, a segment of the cross section in contact with the wearer may be angled or tapered to slope in a downward direction in order to facilitate the flow of sweat into the device, and another adjacent segment may then curve upward to form a channel to capture and divert sweat, and another adjacent segment may curve back inward toward the wearer in order to help retain the sweat within the device so that it may be diverted. In one such variation, a sweat-diverting channel may have an inward facing lip provided to further reduce the likelihood that captured sweat may escape the channel in an unintended direction.

In other variations, the sweat-diverting channels may take a combination of forms or cross-sections. For example, the cross-sectional shape of a sweat-diverting channel may vary along the length of the channel. In some variations, a center portion of the channel may comprise an open lumen or segment configured for collecting sweat, and a side portion of the channel may comprise a closed lumen configured for diverting sweat away from the eyes. In one such variation, in the case of a sweat-diverting channel that adheres to the area between the eyebrows, the portion of the diverting channel which runs in a vertical direction may have a partially or fully enclosed circular cross section, so that sweat which has been collected and diverted cannot escape onto the nose, where it may irritate or tickle the wearer. Such an enclosed or other portion of the channel may be configured not to adhere to the wearer's face, so the sweat may be deposited out the end of the channel away from the wearer's face. For example, a sweat-diverting channel may comprise a bendable portion, wherein the bendable portion may comprise a series of pleats such that the sweat-diverting channel may be deflected.

Other variations of a wearable sweat-diverting device may have segments which are not adherent and traverse areas such as hair to deposit diverted sweat to other areas where diverted sweat may not irritate the wearer. Such variations may be configured to fit around the ears in the manner of eyeglasses, depositing diverted sweat behind the ears or on the back of the neck.

In other variations, a sweat-diverting channel may incorporate an absorbent or wicking material within the channel, such that the captured sweat may not escape the channel and may be directed toward the outlet ends by wicking action. An absorbent or wicking material may also be incorporated into a sweat-diverting device at a location outside the channel, to capture or direct sweat away from the eyes.

In some variations a sweat-diverting channel may be at least partially covered by a filter or membranous material that may permit the flow of sweat into the channel and reduce the likelihood that captured sweat may escape the channel in an unintended direction.

In some variations of a wearable sweat-diverting device, an adhesive may be incorporated into the device at the time of manufacture and covered with a protective backing or release liner, such that the backing may be removed to expose the adhesive prior to use. Such adhesives may cover only certain areas of a sweat-diverting device for optimal adhesion to the wearer. In other variations a sweat-diverting device may incorporate an adhesive flexible fabric or film which may aid in securement of the device to the wearer. In such variations incorporating an adhesive applied at the time of manufacture, the device may be disposable and intended for single use only.

In other variations, a sweat-diverting device may be intended for multiple uses. In such variations an adhesive mechanism may be supplied as a separate component which may be applied prior to the first and/or any subsequent use. In some variations, an adhesive mechanism may be a flexible fabric, film or membranous strip similar to an adhesive bandage with adhesive on one side, wherein a backing material protects the adhesive until the backing is removed for use. In such variations the backing may be removed and the strip applied to the sweat-diverting device and to the wearer. In some such variations the backing material may have more than one part, so that only a portion of the adhesive is exposed by removal of any of the parts, facilitating application of the adhesive to the device and then to the wearer. In other variations the adhesive mechanism may have adhesive on both sides, with backing material covering each. In such variations the backing may first be removed from one side of the adhesive mechanism and the exposed adhesive may be applied to the sweat-diverting device or the wearer. The backing may then be removed from the other side, exposing the other adhesive surface, and the device applied to the wearer. In other variations, the adhesive mechanism may be in a liquid, gel or paste and applied from an applicator to the sweat-diverting device, the wearer or both.

One variation of an adhesive sweat-diverting device configured to be worn above an eyebrow of a wearer without circumscribing the head may comprise a longitudinal base, a first leg joined to the base, and a second leg joined to the base at an acute angle with respect to the first leg. The first leg may comprise a skin-contacting surface comprising an adhesive (optionally, the adhesive may be removable). A channel may be formed between the first and second legs. At least a portion of the base may have a thickness that is greater than the thickness of either the first and/or second legs. For example, the ratio of the thickness of the base to the thickness of either the first and second legs may be from about 1.1: to about 15:1, e.g., from about 1.5:1 to about 15:1, or 1.5:1 to about 5:1. The angle between the first and second legs may be from about 0 degrees to about 90 degrees, e.g., from about 30 degrees to about 60 degrees. In some variations, the base may be tapered. The first and second legs may be made of a first material and the base may be made of a second material, where the second material is more rigid than the first material. Alternatively or additionally, a portion of the first and second legs may be made of the second material. The ratio of the thickness of the base to the thickness of either of the first and second legs may vary from about 1.5:1 to about 15:1. In some embodiments, a portion of the first and/or second leg may be thickened. Optionally, a portion of the second leg may have a pre-shaped bend or hinge to allow bending.

In some variations, the first leg may be made of a flexible material and configured such the device remains adhered to wrinkled or creased skin. Alternatively or additionally, the base may be stiffer or more rigid than both of the legs. The first and second legs may have the same stiffness or rigidity while in some variations, the first leg and second leg may have different degrees of stiffness or rigidity. For example, the second leg may be more rigid or stiff than the first leg, while in other examples, the first leg may be more rigid or stiff than the second leg.

In some variations, the first and second legs of an adhesive sweat-diverting device may extend along a longitudinal length between a first end and a second end. The device may further comprise a first loop located at the first end and a second loop located at the second end. The first and second loops may be open loops. Optionally, at least a portion of the first and second legs may be made of an absorbent material.

Also described are kits that may comprise any of the adhesive sweat-diverting devices described herein and eye glasses, where the base and the second leg extend over an upper rim of the eye glasses. For example, the first leg may be integrated with the upper rim of the eye glasses, and the upper rim of the eye glasses may comprise a skin-contacting surface comprising an adhesive. Other kits may comprise any of the adhesive sweat-diverting devices described herein and a helmet. For example, one variation of a kit may comprise an adhesive sweat-diverting device having a first loop at a first end and a second loop at a second end and a helmet having right and left helmet straps, where the first loop is configured to encircle the right strap and the second loop is configured to encircle the left strap.

Also described herein are adhesive-applying devices. One variation of an adhesive-applying device may comprise a first receptacle configured to retain a sweat-diverting device, and a second receptacle configured to retain a length of adhesive. The sweat-diverting device may comprise a longitudinal base, a first leg joined to the base, and a second leg joined to the base at an acute angle with respect to the first leg to form a channel therebetween, where the first leg has a skin-contacting side. The first receptacle of the adhesive-applying device may be configured to mate with the second receptacle such that the adhesive retained by the second receptacle is aligned with and contacts the skin-contacting side of the first leg. For example, the first receptacle may comprise a recess sized and shaped to retain a sweat-diverting device. Optionally, the adhesive-applying device may further comprise a length of adhesive, where the length of the adhesive is the same as the length of the sweat-diverting device. In some variations, the first receptacle may comprise a clamp that is configured to retain the sweat-diverting device.

Described herein are several shapes, lengths, intended anatomical placement, cross sections, materials and adhesive mechanisms. These examples are for illustrative purposes and are not intended to be limiting. Also, the variations described herein may contain certain combinations of the attributes (e.g., curves, lengths, widths, shapes, etc.) described herein. Such combinations are illustrative and not limiting, and other combinations of the same attributes are intended to be included in this description. It should also be understood that one or more of these attributes may also serve aesthetic or fashion purposes, such as providing a streamlined, fearsome or feature-accentuating appearance.

DESCRIPTION OF THE DRAWINGS

FIG. 2B depicts a cross-section of the sweat-diverting device of FIG. 2A taken along the line A-A. FIG. 2C depicts a cross-section of a sweat-diverting device of FIG. 2A including a protective backing or release liner.

FIG. 3F depicts a first straightened configuration and FIG. 3G depicts a second curved configuration.

DETAILED DESCRIPTION

Figure 1A:
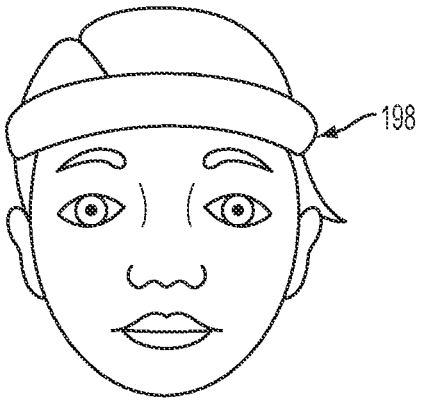
FIG. 1A PRIOR ART
FIG. 1A depicts a sweatband fitted on a wearer.

Described herein are several variations of a wearable sweat-diverting device, coupled to the wearer by an adhesive mechanism. A sweat-diverting device adhered to the wearer may have several advantages over both absorbent headbands and non-absorbent sweat-diverting headbands. For example, a sweat-diverting device affixed to the wearer by a temporary adhesive such as that used in an adhesive bandage may be more comfortable to wear than a sweat-diverting headband. A sweat-diverting device held in place by an adhesive need only cover the area necessary to capture and redirect sweat, rather than circumferentially surround the head. Sweat-collecting or diverting devices that must circumscribe the head are typically worn in a linear path circling the head, which may limit their ability to block sweat from dripping into the wearer's eyes when the wearer is leaning forward or tilting to the side. A sweat-diverting device held in place by an adhesive may help to eliminate or mitigate other problems associated with a sweat-diverting device that circumscribes the head, such as an uncomfortably tight headband fit, binding or pulling on the hair or reducing blood flow and creation of a temporary unsightly impression even after removal of a headband.

A sweat-diverting device adhered directly to a wearer may also be more effective at capturing and diverting sweat which might otherwise flow or drip to the eyes. Such a sweat-diverting device may be placed such that less skin, and thus source of sweat, is exposed between the device and the eyes. In addition, a sweat-diverting device which is adhered to the wearer may be more effective at diverting sweat. A headband-based sweat diverter must be made of material strong enough to be held tightly about the head and as such needs to be thicker than an adherent sweat-diverting device. As a result of the greater thickness it may create a more substantial barrier, allowing sweat to collect above it before it drips into a collection and redirecting channel. Such larger drips may be more prone to dripping over the collection channel. In the case of a sweat-diverting device adhered directly to the wearer, the diverting channel may be formed partly by the skin of the wearer, presenting no barrier to the flow of sweat into the channel. In the case of a sweat-diverting device adhered directly to the wearer and in which the diverting channel is not formed partly by the skin of the wearer, there may be nonetheless a lesser barrier than may be required by a sweat-diverting headband.

A sweat-diverting device adhered directly to the wearer may also divert sweat more effectively by enabling the diverting channel to take any convenient shape rather than to be constrained by the substantially linear shape required for a sweat-diverting headband. A sweat-diverting device adhered directly to the wearer may channel sweat downward around the eyes, rather than just laterally displaced from (but still above) the eyes as in the case of a substantially linear portion of a headband. In some circumstances, such as biking, the wearer may hold his head in a downwardly inclined position. In such cases the sweat captured in a headband device would be biased to flow to the center of the forehead where it may overflow the channel. A sweat-diverting device adhered directly to the wearer may be positioned such that the lateral ends of the channel may be sloped downward from the center, allowing outflow in the desired area.

Figure 1B:
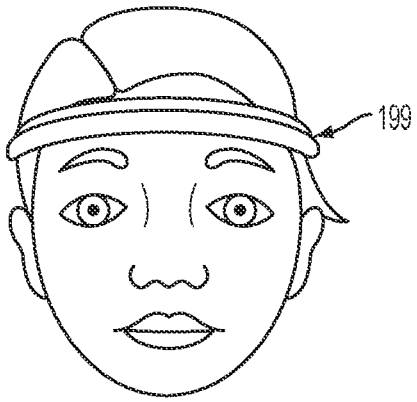
FIG. 1B PRIOR ART
FIG. 1B depicts a sweat-diverting headband fitted on a wearer.
Figure 1C:
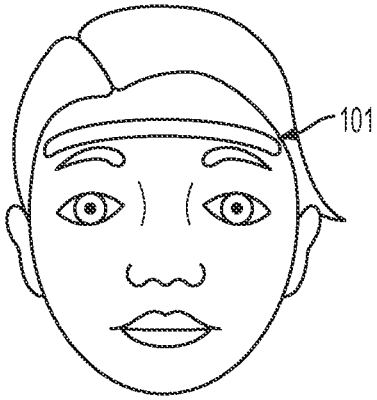
FIG. 1C depicts an adhesive sweat-diverting device fitted on a wearer.

FIGS. 1A-1C depict various devices intended to prevent flow of sweat into the eyes. FIG. 1A depicts an illustrative prior art sweatband (198), which may be exemplary of an absorbent garment used to retain sweat until it becomes saturated. FIG. 1B depicts a prior art sweat-diverting headband (199), which represents a circumferential headband approach to prevention of sweat flow to the eyes. FIG. 1C depicts one variation of a suitable wearable adhesive sweat-diverting device (101) as described hereinthroughout, that may be worn above the eyes to capture and divert sweat from reaching the eyes.

Suitable sweat-diverting devices are described in detail hereinthroughout. However, in general, the sweat-diverting devices described herein can take many forms. They may have a variety of cross-sectional configurations and shapes, be made of a variety of suitable materials, and may contain one or more additional useful features. They may also be placed in a variety of suitable locations on the face to divert sweat away from the eyes of the wearer (e.g., above the eyebrow, below the eyebrow and above the eye, etc.) and be adjusted before or during use. In addition, the sweat-diverting devices described here may be configured for a single-use and be disposable, or may be configured for more than one use and be reusable. The sweat-diverting devices may also include one or more distinctive or ornamental elements, for example, coloring, logos, or other branding. Wearable adhesive sweat-diverting devices may be supplied in lengths or coils such that a desired length may be cut off of the length or coil prior to use. The wearable sweat-diverting devices may also be configured for use with, or be coupled to, one or more devices capable of providing shade from the sun.

Figure 2A:
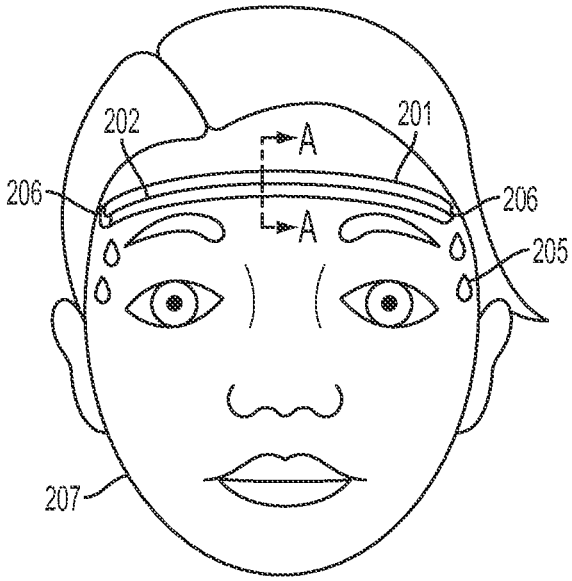
FIGS. 2A-2C depict one variation of a sweat-diverting device as described herein.
Figure 2B:
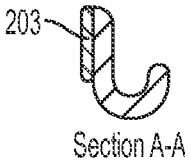
Figure 2C:
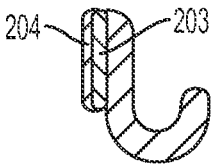

FIGS. 2A-2C depict one variation of an adhesive wearable sweat-diverting device (201). In the variation depicted here, the sweat-diverting device may be made of a flexible material and have a generally U or J-shaped cross section (section A-A), as illustrated in FIG. 2B. A collection channel (202) may capture sweat as it drips down the skin above the wearer's eyes. The device may be coupled to the wearer by an adhesive (203), which may be covered by a protective backing material (204) or release liner prior to use, as shown in FIG. 2C. Sweat (205) may drip into the channel (202), where it may flow to the ends (206) and down the wearer's face (207) away from the eyes. The device (201) may adhere to the wearer's face without fully circumscribing the head, and without any direct communication of one end of the device with another end of the device. For example, the device may be have a length suitable for spanning from ear to ear, temple to temple, eyebrow to eyebrow, or some length in between. In some variations the device has a length of at least 4 inches inches. In other variations the device has a length of at least 5 or at least 6 inches, e.g., 10 inches, 12 inches.

Figure 2D:
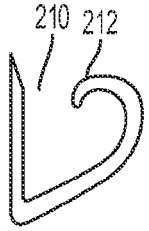
FIGS. 2D-2K depict illustrative cross-sections and additional features suitable for use with the sweat-diverting devices described herein.
Figure 2E:
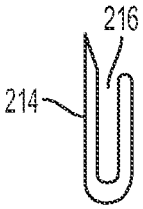
Figure 2F:
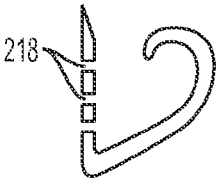
Figure 2G:
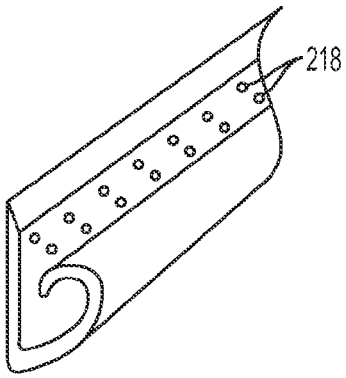
Figure 2H:
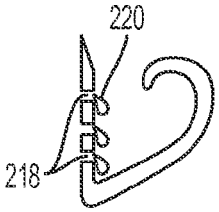
Figure 2I:
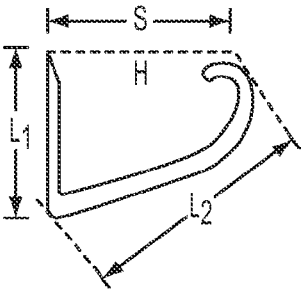
Figure 2J:
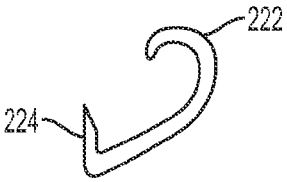
Figure 2K:
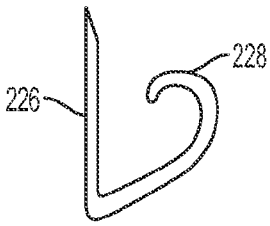
Figure 2L:
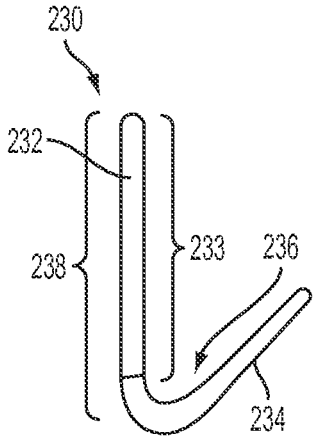
FIGS. 2L-2S depict side views of additional variations of sweat-diverting devices.
Figure 2M:
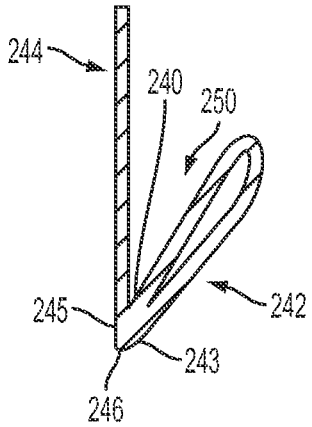
Figure 2N:
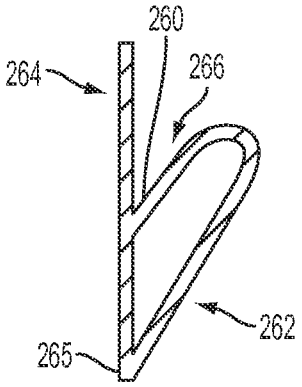
Figure 2O:
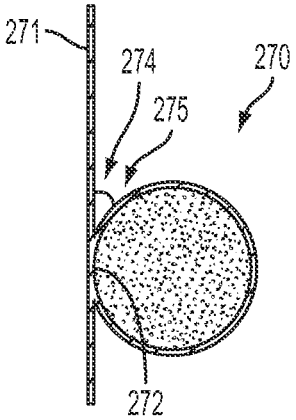
Figure 2P:
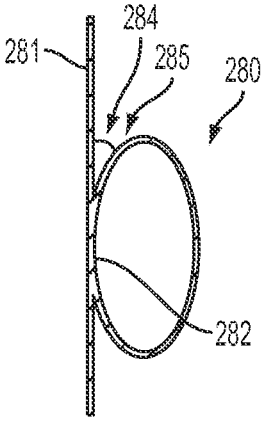
Figure 2Q:
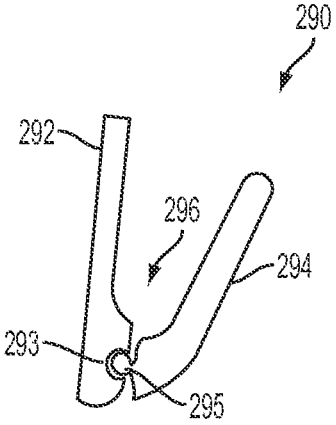
Figure 2R:
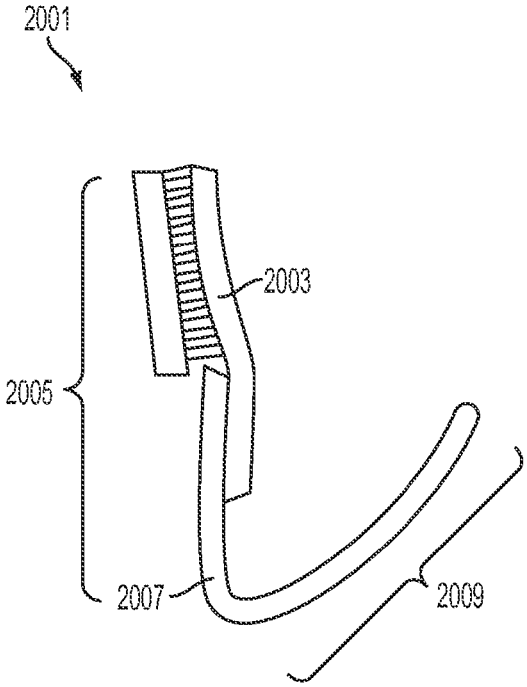
Figure 2S:
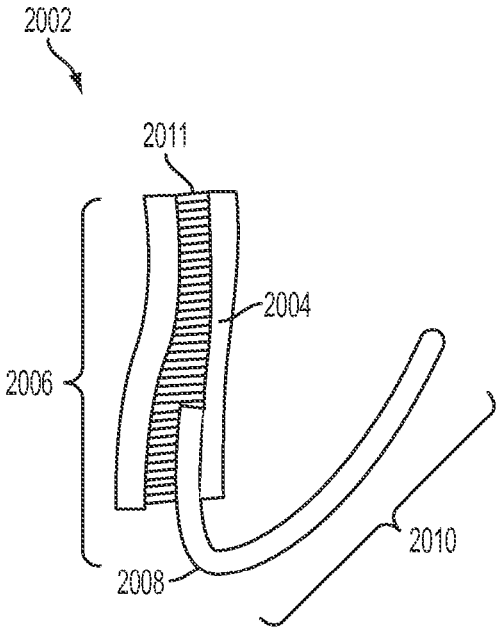

FIGS. 2D-2S depict various illustrative cross-sections of suitable for use with the sweat-diverters and devices described herein. For example, FIG. 2D provides a cross-sectional representation of diverter (210), having a first longitudinal wall or leg and a second longitudinal wall or leg and a longitudinal channel defined therebetween. In this variation, leg (212) curves inward. This may be useful, for example, in retaining collected sweat during head movement of the wearer, such as for example, when the wearer lowers or tilts his or her head. Alternatively, the leg (212) may not have a pre-shaped inward curve, but may assume an inward curve when applied across the surface of a wearer's forward (e.g., along the curvature of the wearer's forehead). FIG. 2E provides another variation of a sweat-diverter (214) having a narrow opening (216), which may be useful, for example in drawing sweat into the diverter by capillary action. Opening (216) may be any suitable width capable of facilitating capillary action, e.g., between about 0.5 mm and about 4 mm. In addition, a sweat diverter may have one or more surface features such as grooves, raised ribs or absorbent elements placed along various portions of the device to promote channeling of sweat produced near the diverter to the ends of the device, where the sweat may then drip away from the eyes of the wearer. FIGS. 2F-2H depict another variation of a suitable sweat-diverter, here having multiple perforations or apertures (218) to facilitate outflow and capture of sweat (220) developed or collected behind the device. FIGS. 2F and 2H provide side views (e.g., cross-sectional views), while FIG. 2G provides a perspective view. While many apertures (218) are shown in this variation, any suitable number of apertures may be used. The apertures may be arranged in any suitable pattern, or may be random in their placement. FIGS. 2I-2K show illustrative dimensions for the sweat-diverter devices suitable for use herein. The spacing (S) between the legs may be configured to provide a wide spacing, and a larger channel, as depicted in FIG. 2I, or spacing (S) may be more narrow, for example, as depicted in FIG. 2K. Similarly, the lengths (L1 and L2) of the legs defining the channel may be the same, or may be different. In FIG. 2I the lengths (L1 and L2) are configured such that the ends of the legs terminate generally at equal height (H). In FIG. 2J, leg (222) extends beyond leg (224), while in FIG. 2K, leg (226) extends beyond leg (228).

FIG. 2L depicts another variation of a sweat-diverter device where the skin-contacting portion of the diverter is semi-permeable to air and/or liquid, and the collection channel portion of the diverter is impermeable to liquid. A skin-contacting region that is semi-permeable to air and/or liquid may help facilitate better adhesion to the wearer, since sweat could more readily pass through the device into the collection channel instead of accumulating between the adhesive and the wearer's skin. Such a configuration may also serve to further increase the sweat collection area above the non-permeable portion of the device. It may also facilitate adhesion of the device to the wearer's face by providing less resistance to wrinkling as the wearer squints, grimaces or otherwise contorts his expression. In such cases a stiffer material may be forced away from the wearer's skin, whereas a more flexible material such as a woven tape may conform to the skin. Sweat-diverter device (230) may comprise a first leg (232) having at least a portion (233) that is semi-permeable to air and/or liquid, and a second leg (234) that is impermeable to liquid, where the juncture of the two legs forms a sweat-collection channel (236). The skin-contacting side (238) of the first leg (232) may comprise a layer or coating of skin-compatible adhesive, such as any of those described herein. The semi-permeable first leg (232) may be made of an impermeable material having multiple perforations or apertures (as described above with respect to FIGS. 2F-2H), or may be made of a semi-permeable and/or wicking material that allows the sweat to pass through. The second leg (234), along with the sweat-collection channel (236) (which may include a bottom portion of the first leg (232)) may be made of a material that is impermeable to liquid, so that the collected sweat does not leak through the channel. Examples of liquid-impermeable materials may include polyethylene, thermoplastic elastomers, silicone, PEBAX, and the like. The dimensions and overall geometry of the sweat-diverter (230) (e.g., the angle between the legs, the curvature of the legs, length, width, and taper, of the legs and channel, etc.) may be similar to any of the sweat-diverters described herein. In some variations, the portion of the first leg that is semi-permeable to air and/or liquid may overlap with the portion that is impermeable to liquid. For example, FIGS. 2R and 2S depict variations of a sweat-diverting device (2001), (2002), where the semi-permeable portions (2003), (2004) of the first leg (2005), (2006) overlap with the impermeable portions (2007), (2008) of the first leg (2005), (2006) and second leg (2009), (2010). Optionally, as depicted in FIG. 2S, the skin-contacting adhesive (2011) may also overlap with the impermeable portion (2008). The semi-permeable material may also be breathable (e.g., air-permeable), which may help to enhance wearer comfort and may also facilitate heat dissipation. Examples of semi-permeable materials may include various types of flexible, woven materials, such as textiles that comprise spandex, polyester, cotton, Dacron, nylon, DRYARN™, AIRTEX™, QUADRI™, COOL LIGHT™, and/or other natural or synthetic fibers and the like.

FIGS. 2M and 2N depict cross-sectional views of other variations of sweat-diverting devices. The outer leg/longitudinal wall may curl inwardly towards the inner leg/longitudinal wall such that the tip of the outer leg touches/contacts or is attached to the inner leg. The tip of the outer leg may be attached to the inner leg by adhesives, welding, soldering, etc. For example, as depicted in FIG. 2M, the tip (240) of the outer leg (242) may curl back towards the inner leg (244) and may attach to the inner leg at or near the juncture (246) of the base (243) of the outer leg (242) and the base (245) of the inner leg (244). The space (250) between the outer surface of the curl and the inner leg (244) forms the sweat-collection channel. FIG. 2N depicts another variation where the tip (260) of the outer leg (262) may curl back towards the inner leg (264) and touches/contacts or attaches to the inner leg (264) above the base (265) of the inner leg. The space (266) between the outer surface of the curl and the inner leg (264) forms the sweat-collection channel. The tip (260) of the outer leg (262) may attach at any point along the length of the inner leg. For example, the tip (260) may attach at about 5%, 10%, 20%, 25%, 40%, 50%, 60%, 75%, 80%, (e.g., 30%) etc. up the length of the inner leg (264).

FIGS. 2O and 2P depict cross-sectional views of other variations of sweat-diverting devices that have a substantially circular and/or round (e.g., oval, ellipse, etc.) cross-sectional shape. A portion along the surface of the sweat-diverting device (e.g., a surface that may be substantially tangential to the overall curvature of the device, a relatively flattened portion of the device) may have an adhesive for attaching the device to a wearer's head. In some variations, the sweat-diverting device may be a longitudinal tube, where the central portion of the tube may or may not be hollow. For example, the sweat-diverting device may be a solid tube (e.g., made of foam), or may be a hollow tube (e.g., made of a sheet material that has been rolled up). The sweat-collection channel may be formed at the juncture where the curved surface of the device contacts with the skin surface. The angle formed between the curvature of the diverter and the curvature of the wearer's head may be adjusted by changing the radius of curvature of the diverter, and may vary from about 10 degrees to about 70 degrees. FIG. 2O depicts one variation of a sweat-diverting device (270) that has a substantially circular cross-section with a flattened portion (272) with a skin-contacting adhesive. The angle (274) between the curvature of the device (270) and the wearer's skin (271) forms the sweat-collection channel (275). FIG. 2P depicts one variation of a sweat-diverting device (280) that has a substantially oval cross-section with a flattened portion (282) with a skin-contacting adhesive. The angle (284) between the curvature of the device (280) and the wearer's skin (281) forms the sweat-collection channel (285).

Any of the sweat-diverting devices and/or sunshade devices described herein may comprise multiple components that may be assembled together by a wearer prior to use. For example, a sweat-diverting and/or sunshade device may comprise a reusable component and a disposable component. The reusable component may be used more than once, while the disposable component may only be used once. The different components may be detachably coupled so that the wearer can disassemble and assemble the device easily. For example, the different components may engage each other via a mechanical interfit (e.g., snap-fit, friction-fit, screw-fit, press-fit, etc.), and/or via a temporary adhesive. FIG. 2Q depicts one example of a two-component sweat-diverting device (290) comprising a first leg (292) that has an adhesive skin-contacting surface and a second leg (294) that is connected to the first leg (292) at an acute angle. A sweat-collection channel (296) is formed in the space between the first leg (292) and the second leg (294). The first leg (292) may have a longitudinal groove (293) at its base and the second leg (294) may have a longitudinal protrusion (295) at its base that corresponds in size/shape to the groove (293) such that the first and second leg may be engaged by snap-fit. In some variations, the first leg (292) may be semi-permeable to gas and/or liquid. Optionally, the first leg (292) may be disposed of after a single use while the second leg (294) may be used multiple times.

Figure 3A:
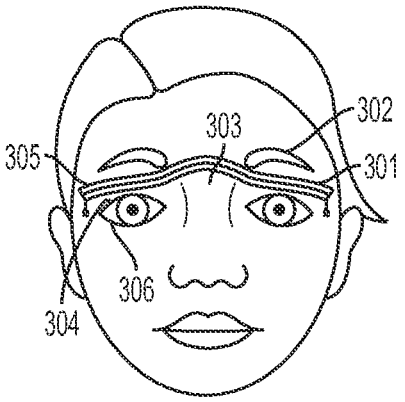
FIGS. 3A-3C depicts several variations of a sweat-diverting device fitted on a wearer.
Figure 3B:
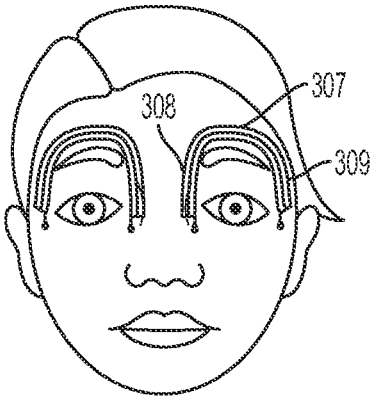
Figure 3C:
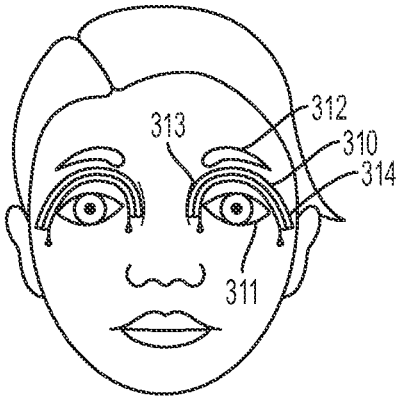
Figure 3D:
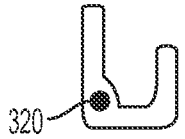
FIGS. 3D-3E depict illustrative variations of a sweat-diverting device comprising a reinforcing member.
Figure 3E:
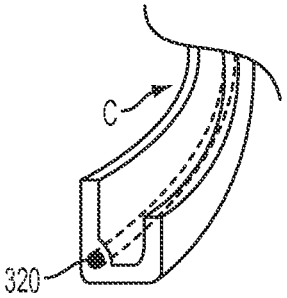
Figure 3F:
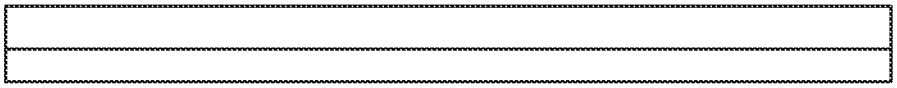
FIGS. 3F-3G are schematic descriptions of a sweat-diverting device that is flexible and/or conformable, where
Figure 3G:
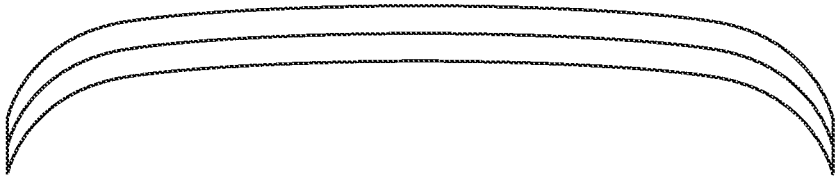

FIGS. 3A-3C depict additional variations of an adhesive sweat-diverting device. FIG. 3A depicts an adhesive wearable sweat-diverting device (301) that may be made of a flexible material and have one or more pre-shaped curves to fit around (e.g., above and/or below) a wearer's eyebrows (302). The device may have a first curve, a second curve, and a third curve, wherein the first and third curves have a radius of curvature that approximate the curvature of the orbits and the second curve has a radius of curvature that approximates the curvature of the glabella. For example, one or more curves may have a radius of curvature from about 0.25 inch to about 2 inches. The device may be contoured to fit over the bridge of the nose (303) and within the orbital sockets (304). The device may further be contoured to provide outlets, with or without tubing, for carrying captured sweat at its ends (305), away from the wearer's eyes (306). The length of the device may be such that the outlets extend laterally past the eyes. In some variations, the length of the device may be from about 4 inches to about 12 inches, for example, from about 6 inches to about 10 inches, or from about 4 to 5 inches, or from about 5 to 6 inches, or about 7 inches to 9 inches or about 7.5 inches or about 9 inches or about 10 inches. The device may be pre-shaped to the approximate shape required, such that it will fit most face sizes. In other variations, the device may have a first straight configuration (e.g., without any pre-shaped curves) as schematically depicted in FIG. 3F, and a second curved or contoured configuration, as schematically depicted in FIG. 3G. The device may have the first configuration before it is applied to a wearer's skin, and assume the second configuration after it has been adhered to the wearer's skin, where the device may have one or more curves to conform to the wearer's forehead. In both configurations, the sweat collection channel remains open (e.g., such that the flow path of sweat within the channel is not impeded) and separation between the tips of the two legs is maintained (e.g., such that the flow of sweat from the wearer into the channel is not impeded). The device may be made of a flexible material to accommodate the exact contour of a given user's face and/or allow a user to bend and shape the device to select a desired sweat-diverting path and/or to have any of the curves described above to accommodate the curvature of a user's face. For example, the user may bend the device from the first straight configuration to the second curved configuration to have two or more curves as the device is adhered to the skin. This may allow the sweat collected by the device to be diverted to a location determined by the user at the time of use. Any of the sweat-diverting devices described herein may be worn across the forehead above the eyebrows, and extend laterally past the eyes such that collected sweat drains away from the wearer's eyes. For example, in the second curved configuration, the left and right ends of a sweat-diverting device may be angled and/or curved downwards past the eyes when worn by the wearer. The wearer may apply the sweat-diverting device and manually shape the ends such that they are angled downward past the eyes, and/or the device may have pre-shaped bends such that the ends are angled downward when worn. Alternatively, the flexible sweat-diverting device may be worn without the ends being angled downward. Such flexible material may also increase the ease of application and comfort of the wearer. The curvature of the various segments may be configured to slope generally from the middle of the device, downward to the ends of the device in order to maximize the gravitational flow of sweat to the ends of the device where it may exit the device away from the eyes of the wearer.

Suitable adhesive wearable sweat-diverting devices as described herein may also be configured to be worn above each individual eyebrow, for example, as shown in FIG. 3B. Such a device may configured to run medially (308) down the side of the nose, and laterally (309) down the side of the face displaced from the eye, with a curved segment in between. Such curved segment may enable the device to conform closely to the contours of the face. Such curves may also enable the device to fit close to the eye, such that as much of the wearer's skin as possible lies above the diversion device, thereby maximizing the catchment area for sweat collection and diversion. FIG. 3C depicts an adhesive wearable sweat-diverting device (310) that may be configured to be worn above each individual eye (311) and below the corresponding eyebrow (312). Such a device may be configured to run medially (313) down the side of the nose and laterally (314) down the side of the face displaced from the eye, with a curved portion in between. Such a curved portion may enable the device to be placed below the eyebrow, thereby maximizing the catchment area for sweat collection and diversion. The curvature of the device may further enable the medial segment (313) and lateral segment (314) to terminate at a level below the eye itself, such that gravity pulls sweat into the device above and around the eye and out of the device at a level below the eye. An adhesive wearable sweat-diverting device (310) may be shaped to have one or more curves which would allow it to conform to most faces, and it may further be flexible to allow it to conform precisely to a broad variety of face contours. As mentioned above, the adhesive wearable sweat-diverting devices may come in various sizes to fit various size faces or may be adjustable to comfort by the wearer.

The wearable adhesive sweat-diverting device may be made of one or more flexible materials or be made of one or more rigid materials or a combination of flexible and rigid materials. A sweat-diverting device may comprise non-absorbent materials, absorbent materials (e.g., wicking materials), or both. For example, the sweat-collecting portions of a sweat-diverting device (e.g., the channel) may be made of a non-absorbent material, while the portions of the device to which the sweat is diverted (e.g., the right and/or left ends of the device) may be made of an absorbent and/or wicking material. In some variations it is desirable for the sweat-diverting devices to be made of one or more flexible materials and/or have no pre-shaped curves such that the wearer may apply it to his or her face to conform it to his or her individual features. In these variations, the sweat-diverting devices may have a first, generally linear, configuration prior to application, and a second, contoured configuration after application, set by the preference and comfort of the wearer. Suitable flexible materials for use with the devices described herein include flexible silicones, EPDM, neoprene, various butadienes, various fluoroelastomers, various thermoplastic or thermoset elastomers, various vinyl esters, polyvinyl chloride, combinations thereof, and the like. Suitable ranges of flexibility or hardness may include materials having hardness of 75 Shore A durometer, or less. For example, suitable durometer ranges may be between about Shore 5 A and about Shore 50 A, between about Shore 7 A and about Shore 40 A, between about Shore 10 A and about Shore 60 A, e.g., Shore 55 A and the like. In some variations, at least a portion of the device may be harder or stiffer than the remainder of the device. The harder or stiffer portions may comprise a material having a hardness of up to Shore 70-85 A durometer. In still other variations, materials having a hardness of Shore 80 A durometer or more may be used, e.g., Shore 85 A durometer or Shore 90 A durometer, etc. Other suitable materials for use with the devices described herein may include a PVC material (e.g., with a durometer of about Shore 30 A, or even up to about Shore 90 A durometer), with a non-phthalate, non-migrating polymeric plasticizer, a thermoplastic elastomer (e.g., a styrenic block copolymer-based thermoplastic elastomer), and the like. The sweat-diverting devices described herein may be made of a material having any hardness, flexibility, tensile modulus (i.e., stretchability), degree of shape memory, etc. as may be suitable for enabling unimpeded facial movement and comfort, all the while staying continuously adhered to the wearer's skin. For example, any of the devices described herein may be made of material(s) with a tensile strength of about 1,500 PSI to about 3,000 PSI, e.g., about 2,000 PSI or 2,100 PSI. The material(s) may also have an elongation ratio of about 200% to about 700%, e.g., about 380% to about 460%, or 200% to about 600%, etc. Flexibility of the device may be enhanced by segments of varying thickness, inclusion of small slits or other apertures, or the like. When slits are included, they may run less than all the way across the device and perpendicular to the length of the device, and may be of such size to enable shaping of the device without allowing fluid to escape through them. Such slits may be 0.1 mm to 2.0 mm in width. In addition or alternatively the device may contain scored sections to increase its flexibility and shapability. Varying the thickness or stiffness of the device may facilitate its ability to remain adhered to the skin despite facial contortions attendant to exertion or otherwise. A thinner or more flexible portion may remain adhered to the skin despite such contortion, while a thicker or a stiffer portion may serve to retain the functional shape of a channel for collecting and diverting sweat.

For example, a sweat-diverting device may optionally include one or more reinforcing members to help maintain the shape of the sweat-diverting device once shaped according to the wearer's preference and comfort level. FIGS. 3D and 3E show a cross-sectional and perspective view respectively of one variation of a sweat-diverter having a reinforcing member (320). As shown there, reinforcing member (320) may be included to help shape the device prior to, or during use. In this variation, reinforcing member (320) is a wire that help maintains curve (C). While shown as a single reinforcing member, any suitable number of reinforcing members may be used. Similarly, while shown as a wire, reinforcing member may be any suitable member having greater rigidity than the diverter.

Figure 13A:
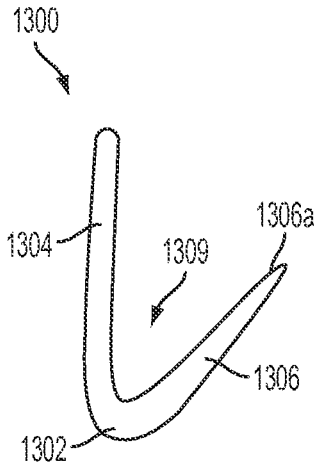
FIGS. 13A-13C depict a side view of one variation of a sweat-diverting device.
Figure 13B:
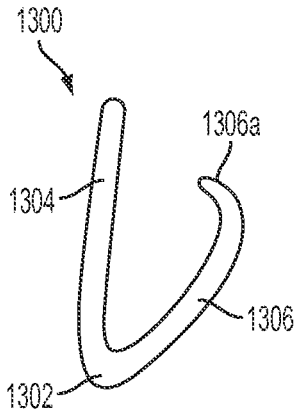
Figure 13C:
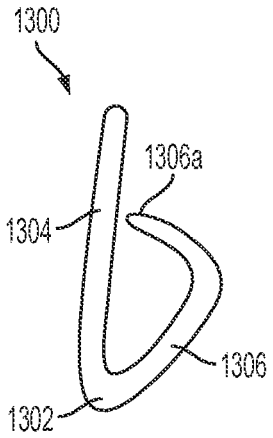

Any of the sweat-diverting devices described herein may have one or more features that may provide additional rigidity to the structures that support the sweat collecting channel so that the channel may be kept open when the sweat-diverting device assumes the second curved configuration (e.g., after the device is applied to a wearer). A problem that may be encountered by an adhesive sweat-diverter (e.g., an adhesive sweat-diverter that does not circumscribe the head) is that the diverter may buckle or/wrinkle due to the contours of a wearer's face, which may cause separation of the diverter from the skin and/or closure of the sweat-diverting channel. For example, a wearer's face may have a plurality of curves due to changing facial expressions and/or anatomical variations. Because the adhesive sweat-diverter is directly adhered to the skin surface, the diverter needs to be able to accommodate such curves and surface variations while reducing the likelihood that the diverter would peel off from the face and/or that the sweat-diverting channel would close up (e.g., when the first and second legs contact each other such that the sweat flow from the skin to the channel is impeded). This potential problem is schematically illustrated in FIGS. 13A-13C. FIGS. 13A-13C depict a cross-sectional representation of one variation of a sweat-diverting device 1300 comprising a base 1302, a first leg 1304 extending from the base and a second leg 1306 extending from the base such that there is an acute angle between the first and second legs. A sweat collecting channel may be formed by the two legs and the base, where the legs form the side walls of the channel and the base forms the bottom wall of the channel. For any of the embodiments of the sweat-diverters described herein, the "base" may be defined as the portion of the diverter that lies below a plane that is tangential to the nadir of the sweat-collecting channel (e.g., as schematically indicated by P1 in FIG. 14B). The legs and/or longitudinal walls of a sweat-diverting device may be defined as the portion of the diverter that lies above the plane that is tangential to the nadir of the sweat-collecting channel and form the sidewalls of the channel. The thickness of the base may be defined as the linear dimension of the device along a line that is perpendicular to the plane P1, annotated as TB in FIG. 14B. The width of the base may be defined as the linear dimension that lies along the plane P1, annotated as WB in FIG. 14B. The thickness of the legs may be uniform along the entire length of the leg, or may vary along the length of the leg (e.g., the leg may be tapered such that the tip of the leg is thinner than the bottom of the leg). In the example depicted in FIGS. 13A-13C, the legs and the base may have the same (or similar) stiffness or rigidity. Prior to applying the sweat-diverter to a wearer's head (e.g., in the first straight configuration), the tips of the first and second legs 1304, 1306 may have sufficient separation such that sweat can readily pass from above the device (e.g., from the top of the first leg) into the sweat collecting channel 1309 (FIG. 13A). After the sweat-diverter is applied to a wearer's skin, and assumes the second curved configuration (e.g., where the sweat-diverter may have at least one curve across the surface of the forehead, and optionally two or more curves, depending on the facial expression of the wearer and the device placement path selected by the wearer), the sweat-diverter may buckle and/or wrinkle to accommodate the curvature imposed upon it. As a result of buckling and/or wrinkling, the diverter may decouple from the wearer's skin and/or sweat flow to and/or through the channel may be impeded. For example, the tip 1306*a* of the second leg may curl inward towards the first leg (FIG. 13B). Alternatively or additionally, the angle between the first and second leg may be reduced after the diverter is applied to a wearer's head. As the tip of the second leg curls in towards the first leg and/or the angle between the first and second legs is reduced, the separation between the two legs may be reduced. In some variations, such reduction in separation, or curling of the second leg, is desirable to help maintain or capture sweat within the channel. However, when the second leg contacts the first leg, the flow of sweat from the top of the legs into the channel may be impeded. Again, while some reduction in the angle between the first and second legs (or curling inward of the first leg) may be desirable and not substantially hinder sweat collection, a large angle reduction (e.g., when the wall of the second leg contacts the wall of the first leg) may hinder sweat collection. For example, the second leg may curl in such that its tip contacts, or nearly contacts, the first leg (FIG. 13C), which may greatly impede the ability of the sweat-diverter to collect sweat into the channel. Alternatively or additionally, the second leg may curl outward and/or downward to create an obtuse angle between the first and second legs, which may cause sweat collected in the channel to spill over the edge of the second leg (instead of draining to the edges of the device). In some cases, the curl of the second leg and/or its angle with respect to the first leg may vary across the length of the diverter, which may result in irregular and/or unpredictable sweat collection and/or drainage. Without wishing to be bound by theory, the irregular curling along the length of the second longitudinal wall or leg may be due to irregular distribution of forces on the diverter as it is placed on the wearer's head (which, in some cases, may result in buckling along the length of the diverter). One possible explanation for the irregular distribution of forces is the irregular stretching of the second leg relative to the first leg. That is, the first leg of the sweat-diverting device that contacts the wearer's skin and the second leg of the device that does not contact the skin have the same longitudinal length at any given distance from the center of the longitudinal length (i.e., along the length of the sweat-collecting channel). However, when applied to the curved contours of a wearer's head, the first leg tracks along an inner curve against the head and the second leg tracks along an outer curve that is longer than the inner curve. Since the first and second legs are the same longitudinal length, this may result in the second leg being irregularly and/or differentially stretched when the sweat-diverting device is applied to a wearer's head. As a result, the second leg may curl irregularly, such that along some portions of the device, the second leg may curl inward while in other portions, the second leg may curl outward and/or downward. For example, the tip of the second leg may curve inward toward the first leg, outwards and/or downwards away from the first leg, and/or may change (e.g., reduce and/or increase) the angle between the first and second legs at different locations along the length of the diverter.

The buckling and/or wrinkling of a sweat-diverter when it assumes a second curved configuration upon application to a wearer's skin may be addressed by reinforcing the angle between the first and second legs so that a relatively consistent acute angle and/or separation between the leg tips is maintained. Different ways of reinforcing the angle and/or separation between the first and second legs and/or biasing the second leg outward are illustrated in the variations described below. It should be understood that the features and/or structures described below may be used alone or in combination to help reinforce the angle and/or separation between the first and second legs and/or to bias the second leg outward when the diverter is in its second curved configuration as it is applied to a wearer. For example, some sweat-diverting devices may have regions of different stiffness or rigidity. One variation of a sweat-diverting device may have a first longitudinal wall or leg, a second longitudinal wall or leg, and a longitudinal base that is connected to the first and second legs (e.g., along the juncture of the first and second longitudinal walls or legs). Optionally, the first and second legs/walls may form an acute angle with respect to each other. At least a portion of the base (or juncture of the first and second longitudinal walls or legs) may be stiffer than the longitudinal walls or legs of the diverter. A sweat-diverter having a base portion that is stiffer or more rigid than the legs may help the diverter maintain consistent and continuous contact between the diverter and a wearer's head and may also help to maintain a desired angle and/or separation between the first and second legs (e.g., so that the angle does not collapse when applied to a wearer's head). In some variations, the base may be stiffer than both of the legs. For example, the base may have a thickness that is greater than the thickness of either of the legs. Where the thickness of a leg varies along its length, the base may have a thickness that is greater than the thickness of the thinnest portion of the leg. In some variations, the ratio of a thickness of the base to a thickness of either of the legs (e.g., the thickness of the thinnest portion of the legs, or the thickness of the thickest portion of the legs) may be from about 1.1:1 to about 15:1, e.g., from about 1.5:1 to about 15:1, or about 1.5:1 to about 5:1. Optionally, the first leg may be a different stiffness and/or thickness than the second leg. For example, the first leg (which has a skin-contacting surface with an adhesive) may be less stiff and/or thick (e.g., more flexible) than the second leg. In other examples, the second leg may be less stiff and/or thick than the first leg. Alternatively or additionally, the stiffness and/or thickness of the legs may vary along the length of the legs (e.g., the bottom portion of a leg may be stiffer than a top portion of the leg, the bottom portion of a leg may be thicker than a top portion of the leg). Another way to reinforce the angle between the legs and/or to maintain a separation between the legs is to provide a stiff or rigid coating around the base and/or bottom portions of the legs. Other variations may comprise a stiff or rigid element (such as a bent wire, or a longitudinal strip of a stiff material with a longitudinal angle that corresponds to the angle between the legs) along the longitudinal length of the base that reinforces the angle and/or separation between the legs, and/or lengthening the second leg/wall so that the longitudinal length of the second leg/wall is greater than the longitudinal length of the first leg/wall. One or more of these reinforcing elements and/or features may be included (alone or in combination) in a sweat diverter to help to bias the curvature of the second leg outwards and/or help to maintain a substantially consistent angle between the legs after it has been applied to the wearer's head. This may help to promote a more even and/or consistent distribution of forces across the length of the device when it is applied to the curved surface of a wearer's head, which may help the legs to maintain a sufficient separation to effectively collect sweat in the channel, and/or help maintain a desirable angle between the first and second legs. Such features may also help to reduce the degree to which a sweat-diverting device strains or deformations under stress.

Figure 14A:
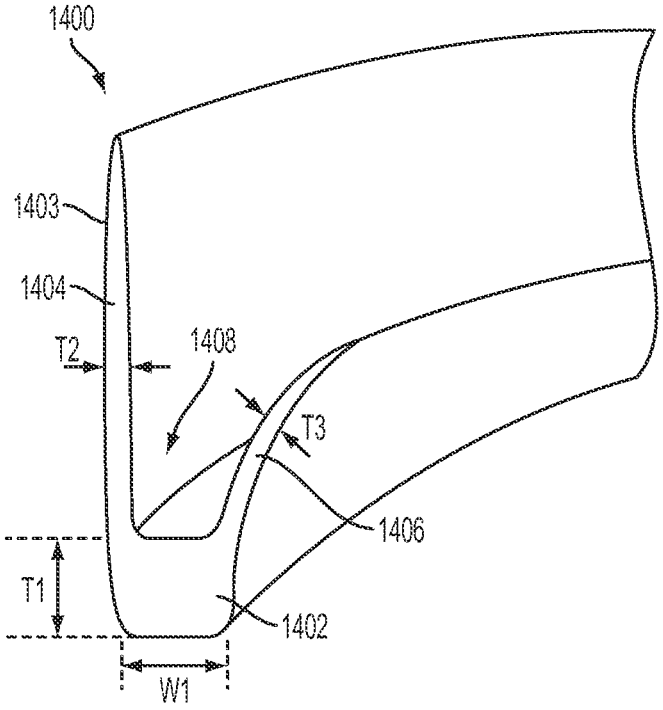
FIG. 14A is a side perspective view of another variation of a sweat-diverting device with a stiffer or more rigid base.
Figure 14B:
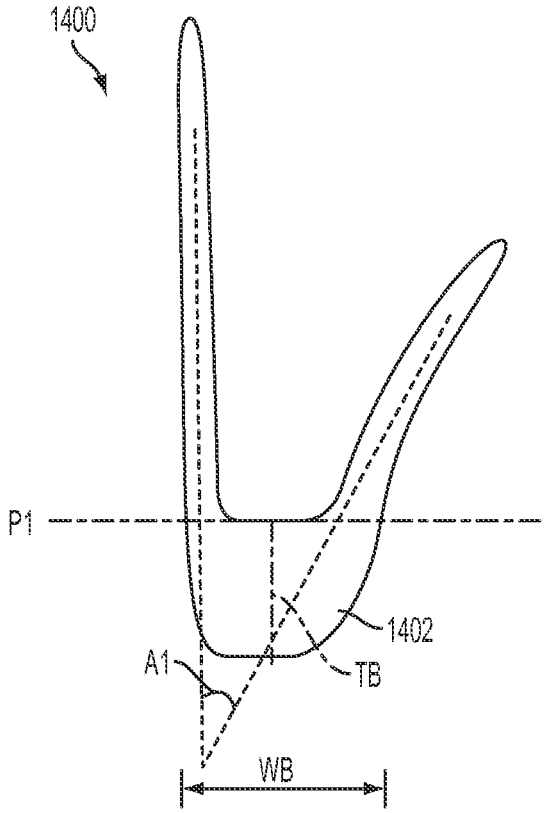
FIG. 14B is a side view of the sweat-diverting device of FIG. 14A.

FIGS. 14A and 14B depict one example of a sweat-diverting device 1400 comprising a first leg 1404, a second leg 1406, and a base 1402 (e.g., the portion of the device formed by the juncture of the first and second leg), where at least a portion of the base 1402 has a thickness that is greater than the thickness of the legs 1404, 1406. The increased thickness may impart greater rigidity or stiffness to the base relative to the rigidity or stiffness of the legs. The collection channel 1408 of the sweat-diverting device 1400 is located between the two legs 1404, 1406 such that the legs form the sidewalls of the channel and the base 1402 forms the bottom of the channel. The outer surface 1403 of the first leg 1404 (i.e., skin-contacting surface) may be coated with an adhesive to attach the diverter 1400 to a wearer. The thickness T1 of the base may be from about 0.3 mm to about 4.0 mm, e.g., about 1.5 mm, while the thickness T2 of the first leg 1404 and the thickness T3 of the second leg 1406 may be from about 0.1 to about 2.0 mm, e.g., about 0.3 mm (thicknesses T2 and T3 may be the same or may be different). While thicknesses T2 and T3 are indicated at a middle portion of the first and second legs, it should be understood that thicknesses T2 and T3 could be the thickness of the thinnest or thickest part of the legs. In some variations, the thickness T1 of the base may be from about 1.25 to about 15.0 times (or more) the thicknesses T2, T3 of the legs. For example, the ratio T1:T2 (and/or T1:T3) may be about 2:1, 3:1, 4:1, 5:1, 6:1, 7:1, 9:1, 10:1, 20:1, 30:1, 40:1, 50:1 (where T2, T3 may be the thickness of the thinnest portion of the legs, or where T2, T3 may be the thickness of the middle portion of the legs, or where T2, T3 may be the thickness of the thickest portion of the legs). Alternatively or additionally, the base 1402 may have a width W1 that is at least the same as, or greater than, the thicknesses T1, T2 of the legs. For example, width W1 may be from about 0.5 mm to about 5.0 mm, e.g., about 3.0 mm. The width W1 may be from about 1.25 to about 10 times the thicknesses T2, T3 of the legs. The thickness of the legs may be uniform along the length of the legs, or may vary (e.g., may be tapered towards the tips as depicted in FIG. 14A). The thicknesses T2 and T3 may refer to the thickness of the thickest portion of the legs. More generally, a sweat-diverter may have a thickened base, a thickened bottom portion of either of the legs, and/or both in order to address the potential problems described above. For example, a sweat-diverter may have a thickened base (e.g., as described above) and a second leg where the bottom of the leg that joins the base is thicker than the tip of the leg. Alternatively or additionally, the bottom portion of the first leg that joins the base may be thicker than the tip of the leg.

Optionally, the first leg 1404 and the second leg 1406 may form an acute angle A1, as depicted in FIG. 14B. Angle A1 may be from about 1 degree to about 89 degrees, e.g., about 45 degrees. The angle A1 may change after the sweat-diverting device is applied to a wearer, but thickening at least a portion of the base and/or one or more of the legs may help to ensure that an acute angle is maintained. Alternatively, the second leg may be substantially parallel to the first leg. In some variations, the base may be tapered and/or may form an acute angle A2 with respect to the first leg, such as the variation of the diverter 1430 depicted in FIG. 14E. For example, the base 1432 may be tapered such that the angle A2 form between the first leg 1434 and the taper of the base 1432 is from about 1 degree to about 89 degrees, e.g., about 45 degrees. The bottom-most portion of a tapered base 1432 may have a radius of curvature from about 0.1 mm to about 10 mm, e.g., from about 0.5 mm to about 10 mm, or about 2 mm Although the top surface 1435 of the base 1432 is depicted as substantially flat, it should be understood that it may be rounded, have a concave or convex curve, as may be desirable.

In some variations of a sweat-diverting device having a tapered base, the angled portion of the base may be thicker than the first and second legs, which may themselves be tapered (e.g., the legs may become thinner as they extend away from the base and/or become wider near the bottom of the legs). For example, the base of a sweat-diverting device may be the junction between the first and second legs, where the first and second legs form an acute angle with respect to each other, and where the angled junction is thicker and/or stiffer than the legs. One or both of the legs may have varying thickness or uniform thickness. While in some variations, the second leg may be straight, in other variations, the second leg may have a tip section that is bent at an angle with respect to a bottom section that joins the first leg at the base of the device. For example, the second leg may have one or more bends or inflections along its length. The one or more bends or inflections may be obtuse (e.g., have an angle greater than about 90 degrees) or may be acute (e.g., have an angle of about 90 degrees or less). In some variations, the tip portion of the second leg may bend or curl inward toward the first leg, but without contacting the first leg. Such bends or inflections may help to prevent sweat collected in the channel from spilling over the edge of the diverter, and/or may have resist eversion of the second leg when applied across a curved contour on a wearer's skin (e.g., forehead).

Figure 14C:
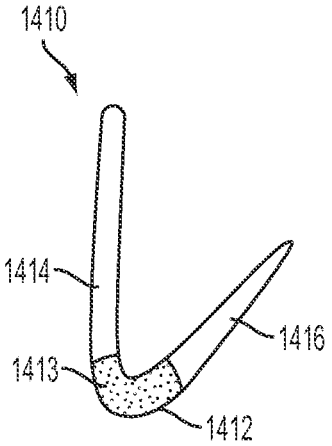
FIG. 14C is a side view of another variation of a sweat-diverting device with a stiffer or more rigid base.
Figure 14D:
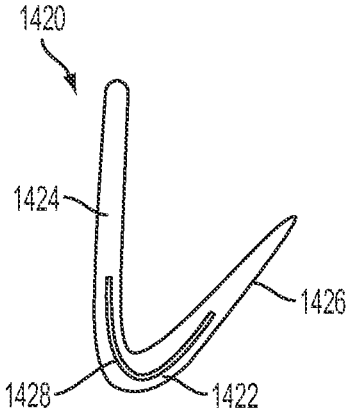
FIG. 14D is a side view of another variation of a sweat-diverting device with a stiffer or more rigid base.
Figure 14E:
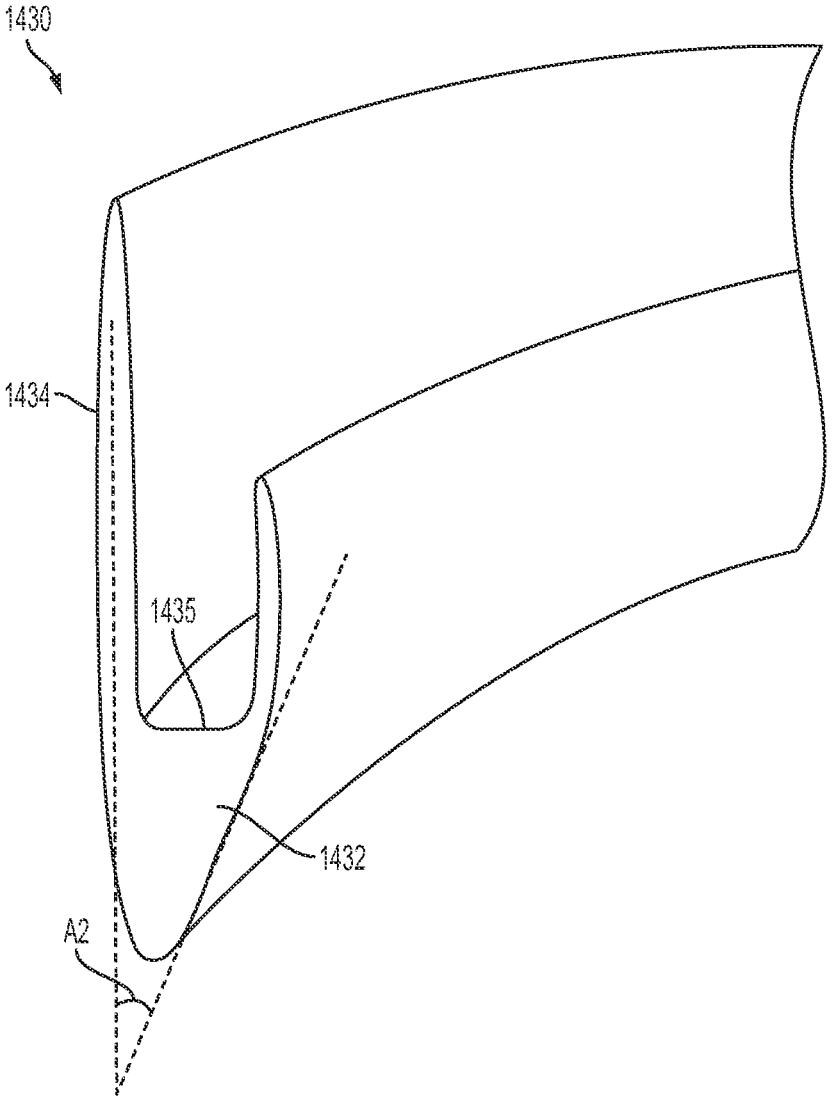
FIG. 14E is a side perspective view of another variation of a sweat-diverting device with a stiffer or more rigid base.
Figure 14F:
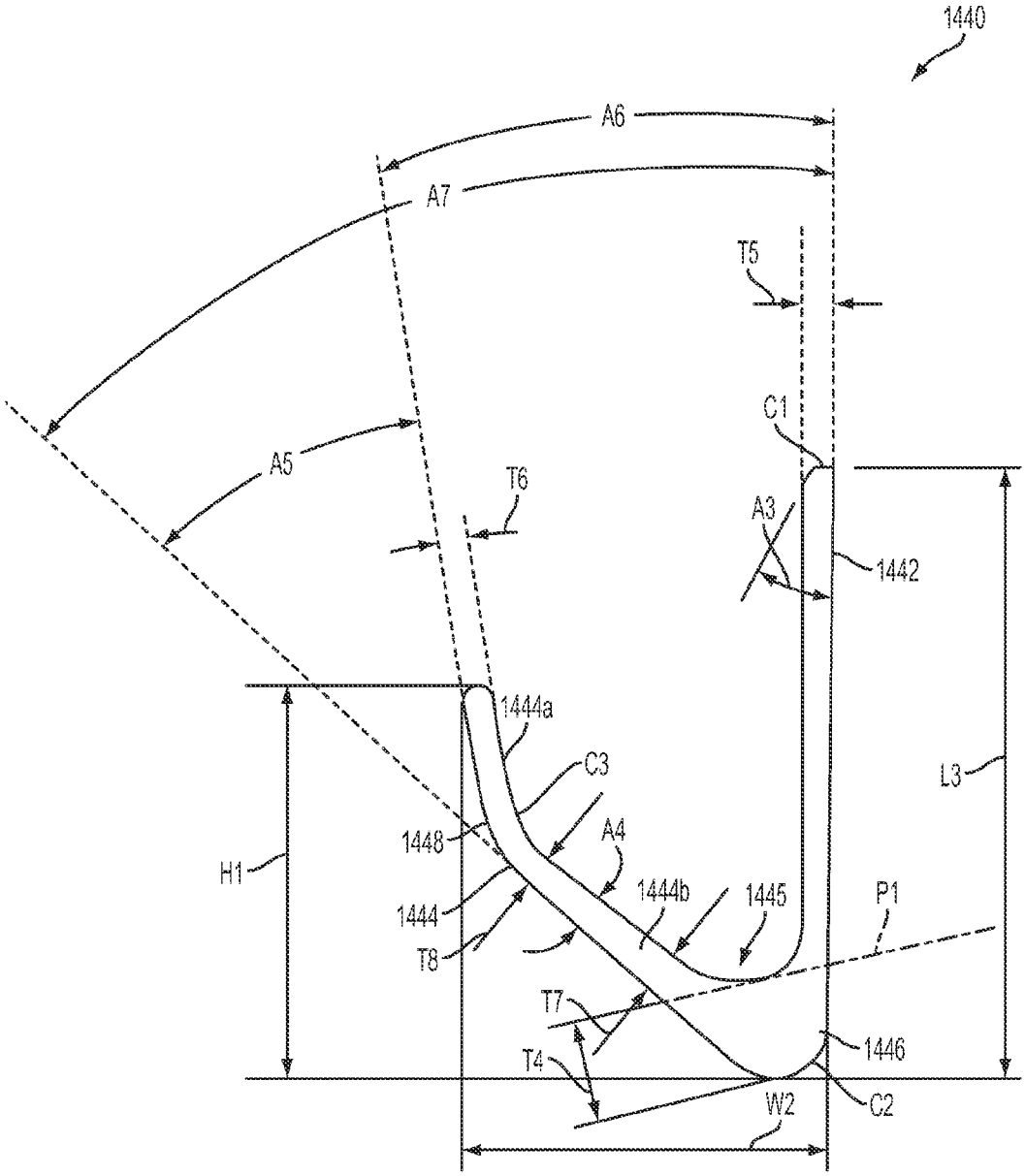
FIG. 14F is a side view of another variation of a sweat-diverting device with a stiffer or more rigid base.

FIG. 14F depicts one variation of a sweat-diverting device 1440 comprising a first leg 1442 and a second leg 1444 that is joined to the first leg 1442 at an acute angle, forming a channel 1445 therebetween. A base 1446 of the device is formed by the junction of the first and second legs 1442, 1444. The first leg 1442 may have a skin-contacting surface (e.g., to which the adhesives described herein may be applied) and the second leg 1444 may form a lip that helps to retain collected sweat within the channel 1445 even if the wearer is leaning forward. The thickness T4 of the base 1446 may be greater than the thickness of the first and second legs. For example, the thickness T4 of the base may be from about 0.035 in to about 0.12 in, e.g. about 0.052 in, while the thickness of the first and second legs may be from about 0.010 in to about 0.025 in, e.g., 0.015 in. The thickness of the first and second legs may be uniform or may vary across their length. For example, the thickness T5 of the first leg 1442 may be about 0.02 in along its entire length, while the thickness of the second leg 1444 may vary from a thickened portion at the bottom (having a thickness T7 of about 0.02 in) to a middle portion (having a thickness T8 of about 0.015 in). The thickness of the tip T6 may be the same as the middle thickness T8, or may be thinner (e.g., about 0.01 in). In other words, at least a portion of the second leg may be tapered (with the thicker portion of the taper towards the bottom), where the taper angle A4 may be from about 1 degree to about 20 degrees, e.g., from about 1 degree to about 4 degrees, about 3.4 degrees. The ratio T4:T5 may be from about 1.1:1 to about 20:1, e.g., from about 1.5:1 to about 20:1, from about 3:1 to about 4:1, about 3.5:1, and the ratio T4:T7 may be from about 1.1:1 to about 20:1, e.g., from about 1.5:1 to about 20:1, from about 2:1 to about 20:1, about 2.6:1. Optionally, the tip of the first leg 1442 may be rounded and/or have a bevel which may help encourage sweat to drip into the channel 1445 instead of beading up on the skin along the top edge or tip of the first leg 1442. The rounded tip may have a radius of curvature C1 from about 0.02 in to about 0.07 in (e.g., 0.05 in), and may have a bevel angle A3 from about 20 degrees to about 40 degrees (e.g., about 30 degrees). The tip of the second leg 1444 may be similarly rounded and beveled, or may simply be rounded (as depicted) or may only have a beveled edge. Optionally, the second leg 1444 may have a bend 1448 such that the tip segment 1444*a* of the second leg forms an angle A5 with respect to the bottom section 1444*b* of the second leg. Angle A5 may be from about 25 degrees to about 60 degrees (e.g., about 40 degrees). The radius of curvature C3 of the bend between the bottom section 1444*b* and the tip section 1444*a* may be about 0.055 in to about 0.65 in, e.g., 0.06 in. The tip segment 1444*a* may form an angle A6 with the first leg that may be from about −15 degrees to about 30 degrees (e.g., about 10 degrees). The bottom section 1444*b* may from an angle A7 with respect to the first leg 1442, where angle A7 may be from about 30 degrees to about 70 degrees (e.g., about 60 degrees). The radius of curvature C2 of the bend between the bottom section 1444*b* and the first leg 1442 (e.g., the curvature of the bottom-most portion of the base 1446) may be about 0.1 in to about 0.4 in, e.g., 0.3 in. The angle A7 between the first leg and the second leg may help to provide a width W2 of the sweat-collecting channel 1445, where W2 may be from about 0.1 in to about 0.25 in, e.g., 0.193 in. The height H1 from the tip of the second leg 1444 to the bottom of the base 1446 may be from about 0.1 in to about 0.3 in, e.g., about 0.2 in. The length L3 from the tip of the first leg to the bottom of the base 1446 may be from about 0.2 in to about 0.4 in, e.g., about 0.313 in. Having a width W2, a height H1, and a length L3 as described above may facilitate the collection of sweat into the channel, and may help provide a deep enough channel to retain the collected sweat. The thickened portion of the base at the junction between the first and second legs may help to reinforce and maintain the angle A7, which may help the second leg to extend far enough away from the first leg so that when the sweat-diverting device 1440 is applied to a curved surface (e.g., a wearer's head), there is a sufficiently wide gap between the tips of the first and second legs to collect sweat.

Figure 14G:
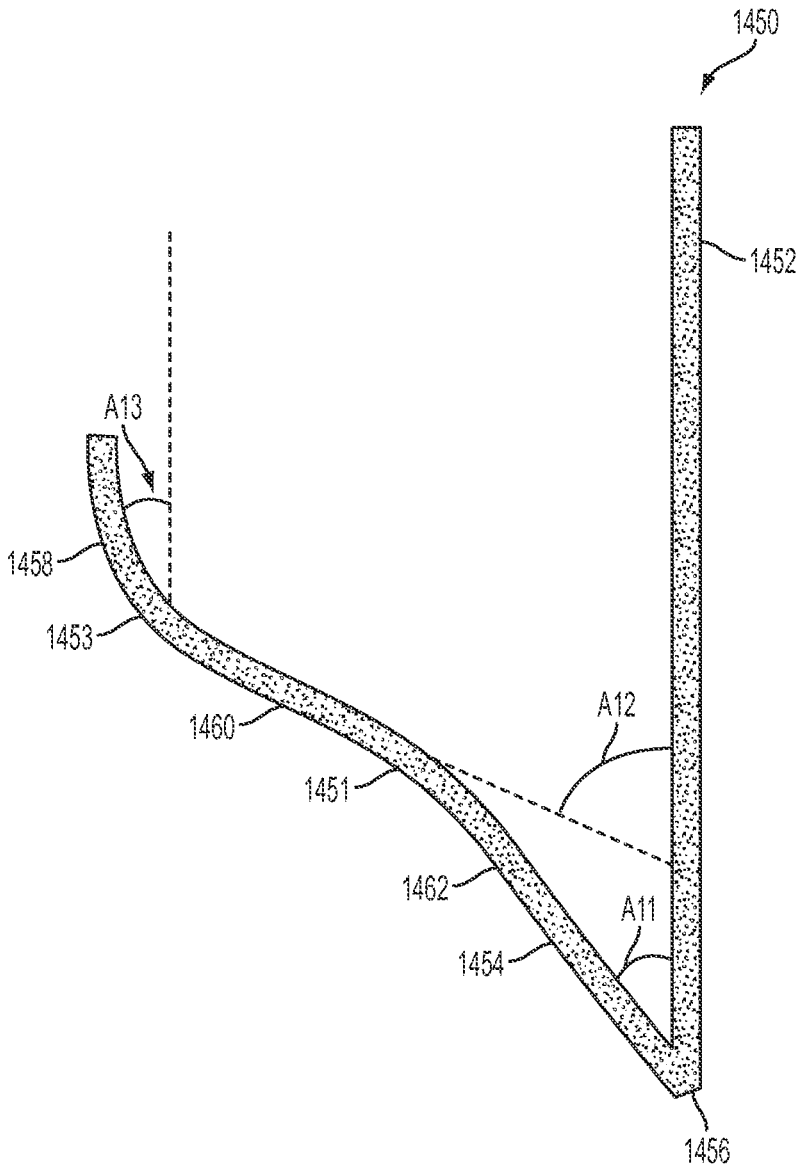
FIG. 14G is a schematic depiction of a side view of another variation of a sweat-diverting device.

One variation of a sweat-diverting device having one or more bends or inflections along the second leg and/or longitudinal wall is schematically depicted in FIG. 14G. As depicted there, sweat-diverting device 1450 has a first leg or longitudinal wall 1452, a second leg or longitudinal wall 1454, which are both joined at a base 1456 such that an angle A11 is formed between them. The angle A11 may be from about 30 degrees to about 85 degrees, e.g., 35 degrees to about 45 degrees. The second leg 1454 may have one or more bends or inflections along its length. For example, the second leg 1454 may have a first bend 1451 and a second bend 1453. The first bend 1451 may have an angle A12 with respect to the first leg 1452, where angle A12 may be from about 50 degrees to about 90 degrees, e.g., from about 45 degrees to about 90 degrees, e.g., about 60 degrees to about 90 degrees. The second bend 1453 may have an angle A13 with respect to the first leg 1452, where angle A13 may be from about 0 degrees (e.g., nearly parallel to the first leg) to about 40 degrees, e.g., from about 10 degrees to about 0 degrees. In some variations, angle A13 may be from about −30 degrees to about −1 degrees relative to the first leg, e.g., about −20 degrees. In some variations, angle A13 may be less than angle A11. Providing an additional bend near the tip with angle A13 may help to resist eversion of the tip of the second leg and provide a sweat retention lip when the device 1450 is attached to a wearer's head. The length of the segment 1458 after the second bend 1453 may be from about 10% to about 30% of the total length of the second leg 1454. The length of the segment 1460 between the first bend 1451 and the second bend 1453 may be from about 30% to about 50%, e.g., 40%, of the total length of the second leg. The length of the segment 1462 between the junction of the second leg to the base and the first bend 1451 may be from about 35% to about 55% of the total length of the second leg. The relative lengths of the segments 1458, 1460, and 1462 may be varied as may be desirable.

Another variation of a sweat-diverting device having a base that comprises a stiffened or rigid portion is depicted in FIG. 14C. The sweat-diverting device 1410 may have a base 1412 and legs 1414, 1416 that all have the same or similar thickness (e.g., may be uniformly thick and/or wide). The base 1412 may comprise a material that is more rigid or hard than the legs. For example, the base may be made of the same or a different polymer having a higher durometer than the polymer of the legs (e.g., any of the polymers described above). Alternatively or additionally, the base 1412 and the legs 1414, 1416 may be made of the same material and durometer, but there may be a coating 1413 over the base region that makes the base more rigid or stiff than the legs. In some variations, the base 1412 may comprise a rigid hinge to which each of the legs may attach. The hinge mechanism may allow for the angle between the legs to be adjusted as may be desirable. In some variations, a portion of the bottom portion of the legs (e.g., the segment of the legs that connect to the base) may have a stiffening coating. As with the sweat-diverting device of FIGS. 14A and 14B, the second leg may be at an acute angle with respect to the first leg. In some variations, the base 1412 may have a curve that joins the first and second legs, where the curve may have a radius of curvature of about 0.5 mm to about 30 mm, e.g., about 10 mm. Alternatively the radius of curvature between each leg and the base may be different.

Another variation of a sweat-diverting device having a base that comprises a stiffened or rigid portion is depicted in FIG. 14D. The sweat-diverting device 1420 may have a base 1422 and legs 1424, 1426 that all have the same or similar thickness (e.g., may be uniformly thick and/or wide). The base 1422 may comprise a stiffening or reinforcing element 1428 embedded therein, which may render the base more rigid or stiff than the legs. For example, the reinforcing element 1428 may be a wire that is embedded within the base, and/or may be a polymer that is stiffer or more rigid than the polymer of the base and/or legs that is configured to reinforce the angle between the first and second legs such that the separation between the tips of the first and second legs is maintained when the sweat-diverter is in its second curved configuration. In some variations, the reinforcing element 1428 may extend along the entire width of the base and to a portion of the bottom portion of one or both the legs (e.g., the segment of the legs that is connected to the base). In some variations, the reinforcing element 1428 may be coextruded with the base and legs of the diverter. As with the sweat-diverting device of FIGS. 14A and 14B, the second leg may be at an acute angle with respect to the first leg. The base 1422 may have a curve with a radius of curvature of about 0.5 mm to about 30 mm, e.g., about 10 mm.

In still other variations, the second leg (e.g., outer leg/wall) may have a longitudinal length that is greater than the longitudinal length of the first leg (e.g., the inner leg/wall that contacts the wearer's skin). For example, the second leg may be about 1% to about 25% longer than the first leg, e.g., about 5%, about 8%, about 10%, about 12% longer. The extended longitudinal length of the second leg may be the same on both sides of the diverter (e.g., such that the first leg is longitudinally centered with respect to the second leg), or may extend at different lengths on either side of the diverter (e.g., the second leg may extend past the first leg more on the left side than on the right side, or vice versa). For example, the second leg/wall may have an extended length on either side of the diverter to accommodate the curvature of a wearer's temples. In still other examples, the additional longitudinal length of the second leg/wall may curve towards the first leg/wall such that the separation between the first and second legs is reduced towards the right and left ends of the diverter.

Any of the features of the sweat-diverters described herein throughout may be used alone or in combination with other features to reinforce the angle between the first and second legs/longitudinal walls and/or to help ensure the sweat collecting channel remains open and/or help prevent buckling after the diverter is applied to a wearer and/or to prevent sweat from flowing out of the device in an unintended direction. For example, the combination of a thicker, wider, and angled base may provide the rigidity necessary to prevent the diverter from buckling when adhered to a wearer. However, in other variations, a sweat-diverting device may have a base that is wider than the sum of the thickness of the two legs, but has the same thickness as either leg individually. Optionally, the second leg may be at an acute angle with respect to the first leg, or may be substantially parallel to the first leg. Alternatively or additionally, the base may be tapered or angled with respect to the first leg. Some variations may have a second leg and base that are both thicker than the first leg, and optionally the second leg may have about the same thickness as the base. In still other variations, the base may be thicker than both of the legs, and may also include a stiffening coating along the curvature of the base. In other variations the first leg and second leg may be of any thickness, provided the thickness in the region of the base is thick enough to resist buckling.

Figure 4A:
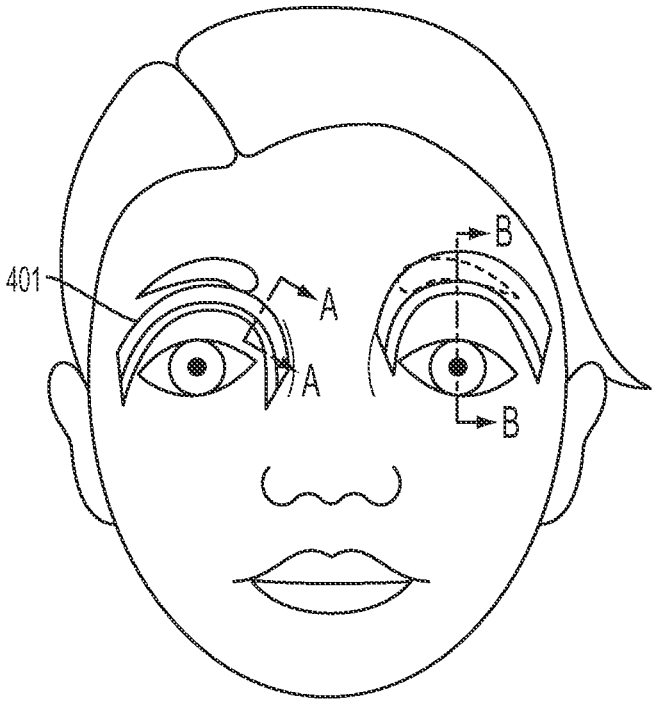
FIG. 4A depicts one variation of sweat-diverting devices that may be fitted over the eyes of a wearer.
Figure 4B:
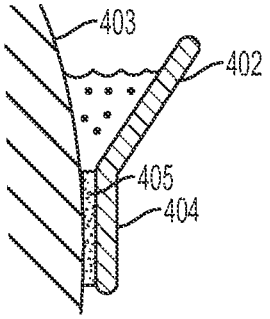
FIG. 4B depicts a cross-section of the sweat-diverting device of FIG. 4A taken along the line A-A.
Figure 4C:
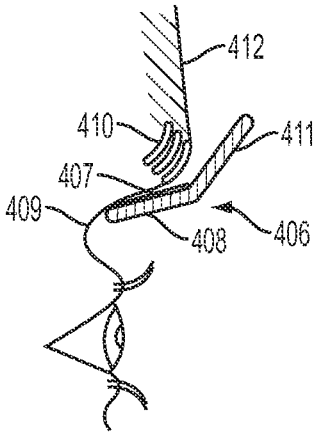
FIG. 4C depicts a cross-section of the sweat-diverting device of FIG. 4A taken along the line B-B.
Figure 4D:
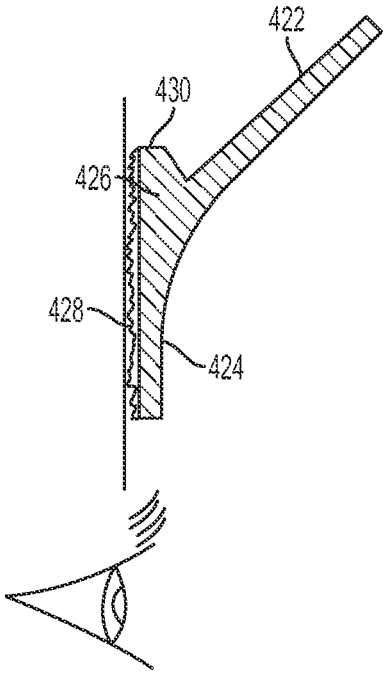
FIGS. 4D-4F depict alternative variations of sweat-diverting devices that comprise two legs joined at a base portion and having an obtuse angle between them.
Figure 4E:
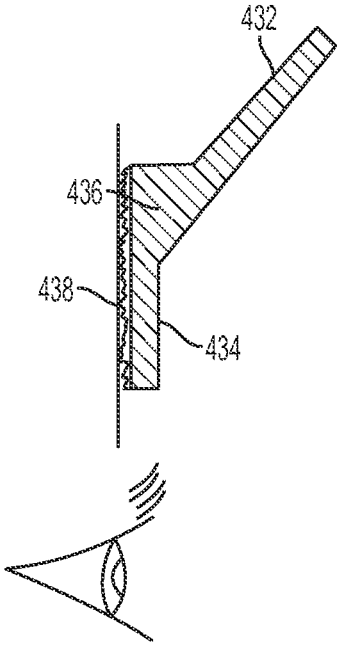
Figure 4F:
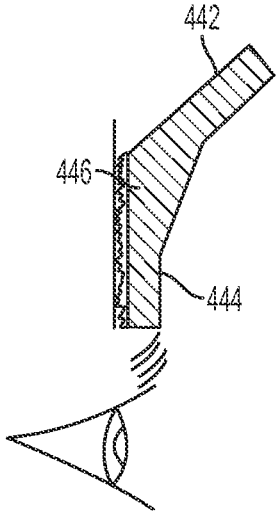

FIGS. 4A-4D depict other variations of an adhesive wearable sweat-diverting device. Adhesive wearable sweat-diverting device (401) may be made of a flexible or rigid material and may or may not have one or more angles or curves. As shown in FIG. 4B (section A-A), when applied to the wearer, a first leg (402) may form one arm of a generally V-shaped sweat-diverting channel, and the wearer's skin (403) may form the other arm of the channel. A second leg (404) of an adhesive wearable sweat-diverting device may have adhesive backing (405) for attachment of the device to the skin. As shown in FIG. 4C (section B-B), an adhesive wearable sweat-diverting device (406) may have adhesive backing (407) on one leg (408) for coupling the device to the wearer's skin (409). The adhesive backing (407) may be positioned on one leg (408) such that the leg may extend away from the skin without sticking to a facial feature such as an eyebrow (410). A second leg (411) of an adhesive wearable sweat-diverting device may extend at an angle from the first arm to form a barrier against the flow of sweat and one side of a sweat-diverting channel. The wearer's skin (412) may form another side of the sweat-diverting channel. FIGS. 4D-4F depict others variation of an adhesive wearable sweat-diverting devices having two legs that join at a base portion at an obtuse angle, where the base portion is thicker than either of the legs. For example, as shown in FIG. 4D, first leg (422) joins second leg (424) at base portion (426). In this variation, second leg (426) may be coupled to the users skin via an adhesive (428). A sweat-diverting channel is formed between the user's skins (e.g., forehead) and first leg (422). In the variation shown in FIG. 4D, base portion (426) has a portion (430) that angles toward, and forms a ridge against, the user's skin. FIG. 4E depicts a similar variation, where first leg (432) joins second leg (434) at base portion (436). Again, in FIG. 4E, the base portion is wider and thicker than either of legs (432) or (434), and a sweat-collection channel is formed between the first leg (432) and the user's skin (e.g., forehead) when the device is applied to the skin via adhesive (438). In the variation shown in FIG. 4E, the base portion (436) has no ridge or protruding portion. FIG. 4F shows an alternative variation where first leg (442) and second leg (444) are joined at base portion (446). In this variation, base portion (446) has no angled portion or protruding portion. It should be noted that in each of these variations, the legs may have any suitable length. In some variations the first and second leg are of equal length, in some variations, the second leg is longer than the first leg, and in yet other variations, the first leg is longer than the second leg. While a few illustrative variations have been depicted here, it should be noted, that additional enhancements or features of any of the sweat-diverting devices described herein throughout may also apply to the embodiments described in this and other paragraphs.

Figure 5A:
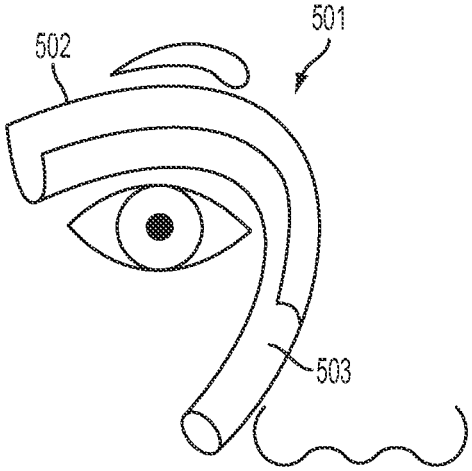
FIGS. 5A and 5B depict other variations of sweat-diverting devices that may be positioned over the eyes.
Figure 5B:
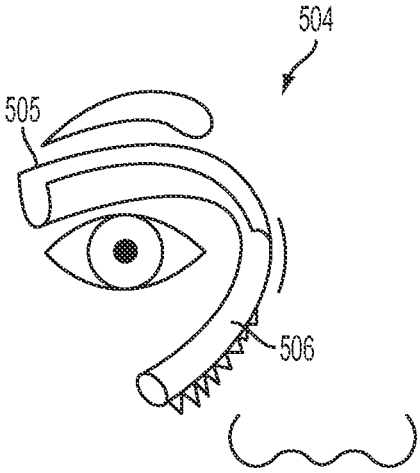

FIGS. 5A and 5B depict other variations of an adhesive wearable sweat-diverting device. Adhesive wearable sweat-diverting device (501) may be made of a flexible or stiff material, or a combination thereof, and may have one cross-section at one segment (502) of the device and another cross-section (503) at another cross section of the device. As illustrated in FIG. 5A, the adhesive wearable sweat-diverting device (501) may have a generally U-shaped cross section in a segment positioned to capture and divert sweat from reaching the eyes, and a generally circular cross-section in a segment positioned to divert sweat captured in another segment of the device, although, as described in detail below, additional cross-sections may be used. Such a transition in cross-section may enable a first segment of the device to perform at least one function, and a second or other segment to perform at least one function different from a function performed by the first segment. FIG. 5B illustrates an adhesive wearable sweat-diverting device (504) that may have at least one segment (505) adhesively coupled to the wearer and at least one other segment (506) not adhesively coupled to the wearer, e.g., not coupled to the wearer.

Figure 6A:
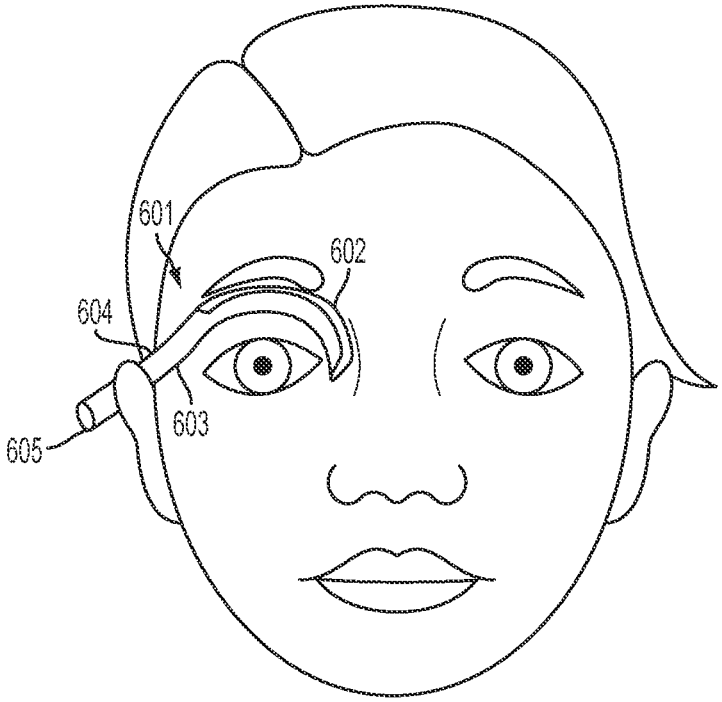
FIG. 6A depicts a front view of another variation of a sweat-diverting device.
Figure 6B:
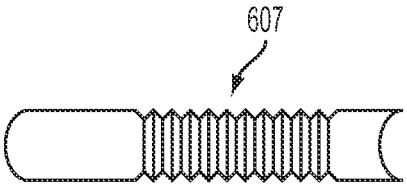
FIG. 6B depicts a bendable segment of a sweat-diverting device.
Figure 6C:
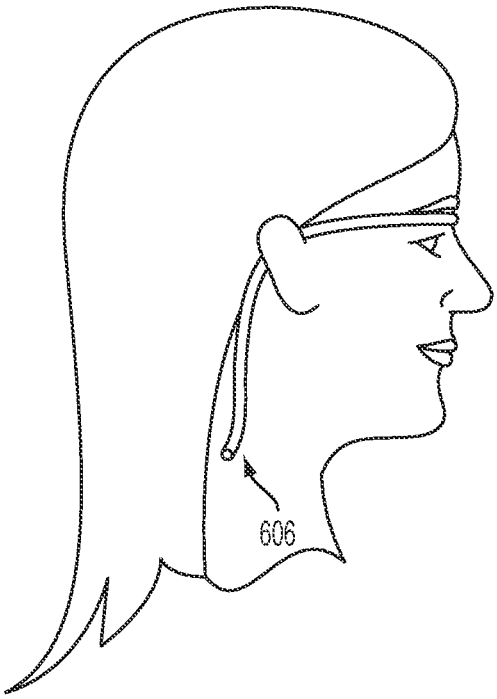
FIG. 6C depicts a side view of one variation of a sweat-diverting device.

One example of an adhesive wearable sweat-diverting device (601) which has at least one segment not adhesively coupled to the wearer is depicted in FIGS. 6A-6C. In one variation, the adhesive wearable sweat-diverting device (601) may have a first segment (602) with a generally U-shaped sweat-diverting channel in a portion that may be positioned above the wearer's eye, and a second or other segment (603) with a generally circular cross-section that may traverse the wearer's face and some of the wearer's hair. Such second or other segment may have at least one area (604) in which it is not adhesively coupled to the wearer so that it does not stick to the wearer's hair. The third or other segment may be positioned (605) to release captured sweat in an area where it may not irritate the wearer, such as behind the ear or back of the neck (606), as shown in FIG. 6C. A segment (607) of such a device may have a cross-section in a generally accordion shape having a plurality of pleats in order to enable it to maintain a shape or directionality defined by the wearer (FIG. 6B). In some variations, the entire length of a sweat-diverting device may have a plurality of pleats. For example, the adhesive portion (e.g., skin-contacting portion) of the sweat-diverting device may have a plurality of pleats. Alternatively or additionally, the walls of the sweat collection channel and/or the base of the channel may have one or more pleats. A first portion (602) of such device may have a preformed curve, which may be shaped to fit within the orbit and against the lateral side of the nose. Such preformed curved section (602) may further be partially deformable so that the device may fit wearers with different size orbits. Devices such as those described in this paragraph may be comprised of sheet goods such as paper.

Figure 7A:
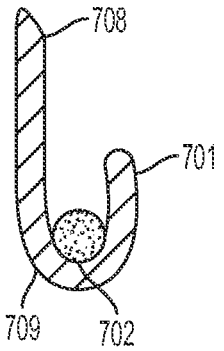
FIGS. 7A-7C depict various cross-sections of a sweat-diverting device.
Figure 7B:
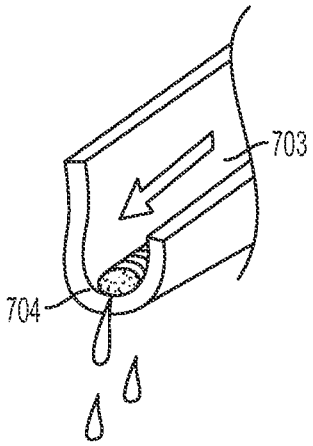
Figure 7C:
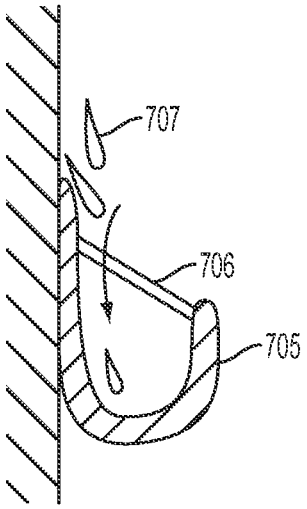

As mentioned above and described hereinthroughout, the sweat-diverting devices described herein may include one or more additional useful features. For example, FIGS. 7A-7C illustrate various sweat collecting channels of suitable sweat-diverting devices comprising one or more additional useful features. FIGS. 7A and 7B depict a channel (701) having a wicking or other absorbent material (702), e.g., a polymer wicking material. While shown in FIG. 7A as positioned such that it may guide sweat captured by the channel along the bottom of the channel (703) to prevent sweat from leaking out of the channel other than at the end of the channel (704), the absorbent material may be placed in any suitable location (e.g., at the top of the device (708) or at or near the outer bottom of device (709)). Alternatively the absorbent material may be placed outside the channel, for instance below the channel, to absorb and redirect sweat produced below the level of the device in use. Alternatively or additionally, a channel (705) may have a membrane or filter cover (706) which may allow sweat (707) to enter the channel and make it relatively more difficult for sweat to exit the channel in the reverse direction (FIG. 7C).

Figure 8A:
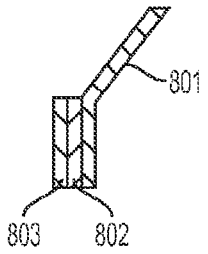
FIGS. 8A-8D schematically depict various adhesive mechanisms for a sweat-diverting device.
Figure 8B:
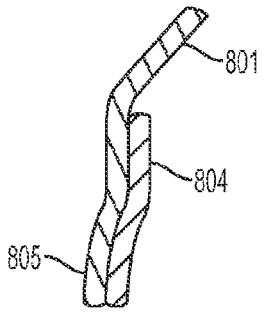
Figure 15A:
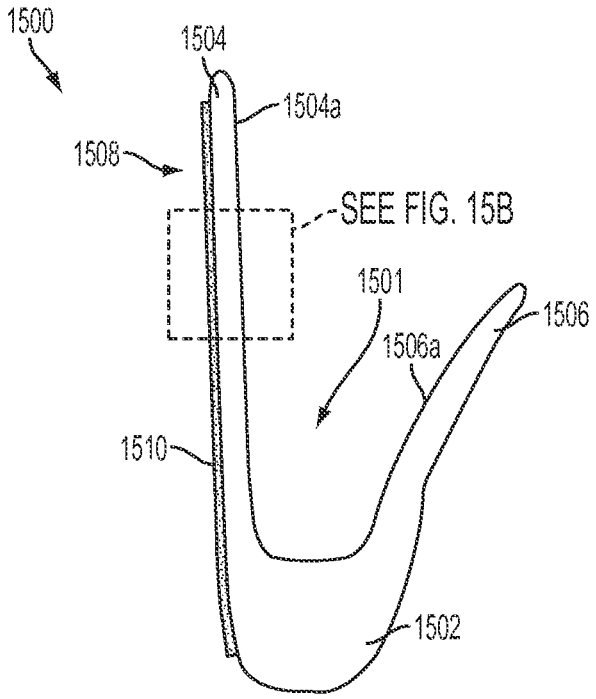
FIG. 15A is a side view of an example of a sweat-diverting device.
Figure 15B:
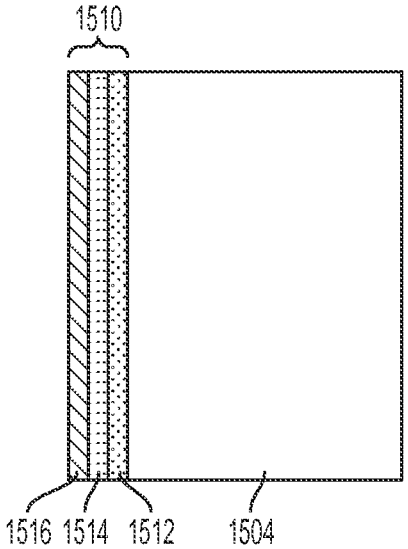
FIG. 15B is a close-up view of the portion of the sweat-diverting device of FIG. 15A enclosed in dotted lines.

FIGS. 8A-8D depict several attachment mechanisms for use with the sweat-diverting devices described herein, for example, device (801). As shown in FIG. 8A, the sweat-diverting device 801 may comprise an adhesive attachment mechanism (802) (which may be applied at the time of manufacture and/or applied by a wearer) and a protective backing material or release liner (803) that may cover the adhesive attachment mechanism until the time of use. FIG. 8B depicts a flexible strip (804) with adhesive on one side, which may be applied at the time of manufacture or by the user prior to use, and the strip may have at least one portion where the adhesive is covered by a protective backing material (805) until the time of use. Some variations of a sweat-diverting device may have a skin-contacting surface that comprises a skin-compatible adhesive for attachment to a wearer's head. Such adhesive may be applied at the time of manufacture and/or re-applied by the wearer (e.g., to refresh the adhesion after one or more uses). Optionally, the adhesive may be removed between re-applications by the wearer. FIGS. 15A and 15B depict a sweat-diverting device (1500) having a first leg 1504, a second leg 1506, and a base 1502 to which the first and second legs are attached. A sweat-collecting channel 1501 is formed and bounded by the inner wall 1504*a* of the first leg 1504, inner wall 1506*a* of the second leg 1506 and the base 1502. The base 1502 may be thicker and/or wider than either of the legs, which may render it more rigid or stiff than the legs. The first leg 1504 may have a skin-contacting surface 1508 (opposite the inner wall) comprising an adhesive backing 1510. The adhesive backing 1510 may comprise multiple layers. FIG. 15B is a close-up view of the portion enclosed in the box marked in FIG. 15A. For example, where the legs and base are made of PVC and/or a thermoplastic elastomer, the adhesive backing 1510 may comprise a PVC-compatible (and/or thermoplastic elastomer compatible) adhesive layer 1512, a plasticizer blocker layer 1514, and a skin-compatible adhesive layer 1516 adjacent to the blocker layer. The plasticizer blocker layer 1514 may help to prevent the migration of plasticizers in the PVC or thermoplastic elastomer into the skin compatible adhesive, which plasticizer may foul the skin-compatible adhesive layer 1516. Alternatively, the PVC-compatible adhesive 1512 may itself prevent plasticizer from fouling the skin-compatible adhesive, which may eliminate the need for the plasticizer blocker layer 1514. In some variations, adhesive backing may comprise non-migrating plasticizers, which may reduce the number of layers of the adhesive backing. Optionally, on one side of the skin-compatible adhesive layer (i.e., opposite the side that is in contact with the blocker layer) there may be a release liner (not shown) that protects the skin-compatible adhesive layer before it is used. The skin-compatible adhesive layer may comprise, for example, an acrylate. While the adhesive backing 1510 may be applied to the sweat-diverting device during the manufacturing process, in some variations, an adhesive backing may be removed from the device and/or re-applied by the wearer. In those variations, the adhesive backing 1510 may be separate from the sweat-diverting device and may comprise a first release liner contacting the skin-compatible adhesive layer 1516 and a second release liner contacting the PVC-compatible adhesive layer 1512. The first and second release liners may protect the adhesive quality of the skin-compatible adhesive layer 1516 and the PVC-compatible adhesive layer 1512 until just before the adhesive backing 1510 is to be applied to a sweat-diverting device. Other suitable adhesive materials that may be used with any of the sweat-diverter devices described herein may include pressure sensitive adhesive materials, such as synthetic rubber/resin blends and acrylates, which may be available from various suppliers (e.g., Dow Corning, Styron, 3M, MBK, Dymax, LD Davis Industries). Other adhesives may include any rubber adhesives (e.g., hydrophobic polymers such as polyisoprene, polyisobutylene) that may be combined with small-molecule tackifiers, plasticizers, and/or antioxidants, any acrylic adhesives (e.g., acrylic monomers), and/or any silicone adhesives (e.g., polydimethylsiloxame polymers with or without silicate resin reinforcers and tackifiers, soft gel silicones). Adhesives may be applied to the skin-contacting surface by any suitable method, including, but not limited to, spraying, hot melting, co-extrusion, tape transfer, and the like. For example, the adhesive may be in the form of a transfer adhesive, or single-coated or double-coated tapes. It should be understood that the adhesive need only cover various portions of the leg attaching to the wearer, and may not cover the entire skin-contacting surface of the leg.

Figure 8C:
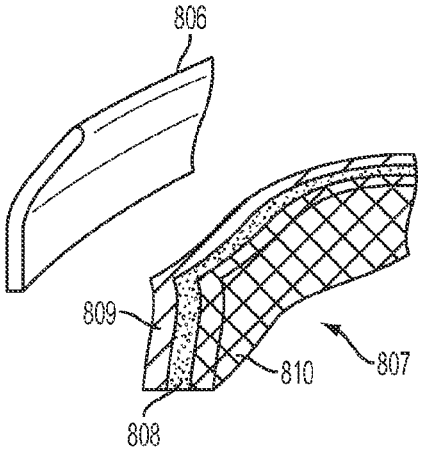
Figure 8D:
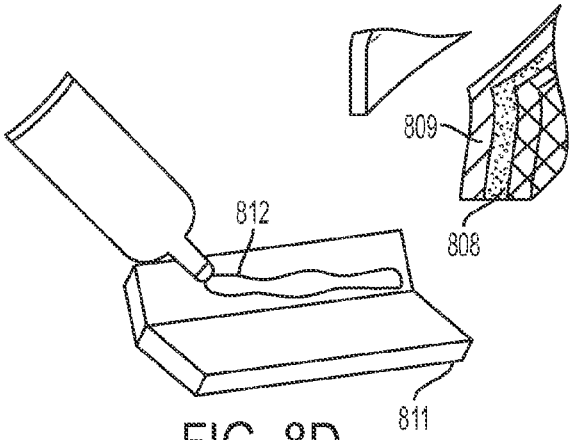

A wearable sweat-diverting device may be intended for single or multiple uses before disposal. For example, as illustrated in FIG. 8C, a wearable sweat-diverting device (806) intended for multiple uses prior to disposal may have an adhesive mechanism applied by the user at the time of use. An adhesive mechanism (807) may be a film of adhesive, a flexible strip (808) coated with adhesive on both sides or a two adhesives which may be in direct apposition or separated by a flexible strip, and the adhesive(s) may be covered with protective backing material (809, 810) which may be removed prior to use. A first piece of backing material (809) may be removed first and the adhesive strip applied to the wearable sweat-diverting device (806). A second piece of backing material (810) may later be removed to expose the other adhesive surface, and the wearable sweat-diverting device applied to the wearer. In some cases of and adhesive wearable sweat diverter, the adhesive for the initial use may be applied at the time of manufacture, and subsequent applications of adhesive may be accomplished as described above. FIG. 8D depicts a wearable sweat-diverting device (811) that may be used multiple times prior to disposal. The sweat-diverting device (811) may be attached to a wearer using a gel- or liquid-based adhesive (812) mechanism, where the gel- or liquid-based adhesive may be applied by the user at the time of, or prior to, use or integrated into the device at the time of manufacture. In some variations, the device may incorporate an adherent material that retains its adhesive properties over multiple uses.

Figure 16:
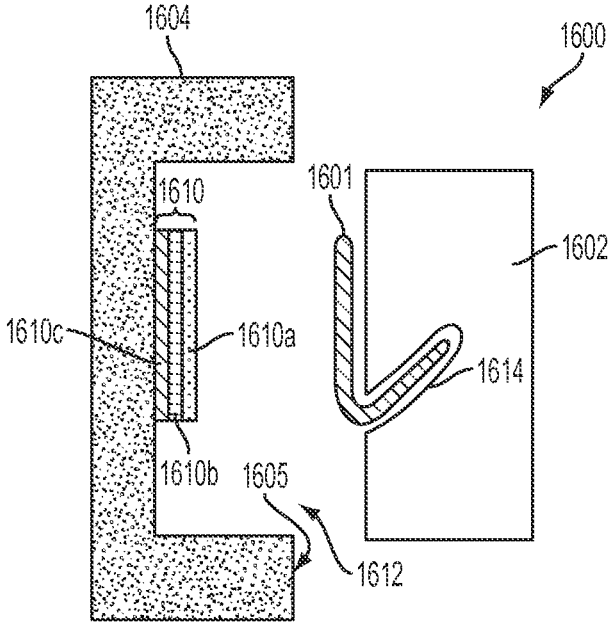
FIG. 16 depicts one variation of an adhesive-applying device that may be used with any of the sweat-diverting devices described herein.

One variation of a device for applying an adhesive layer to the skin-contacting surface of a sweat-diverting device is depicted in FIG. 16. FIG. 16 depicts a cross-sectional view of an adhesive-applying device 1600 comprising a first receptacle 1602 for retaining a sweat-diverting device 1601 and a second receptacle 1604 for retaining an adhesive backing 1610, wherein the second receptacle has a recess 1612 that is sized and shaped to retain the first receptacle 1602. The first receptacle 1602 may be configured to mate with or fit into the recess 1612 such that the skin-contacting surface of the diverter 1601 is aligned with the adhesive backing 1610. When the adhesive properties of the adhesive backing of the diverter have been exhausted, the diverter may be placed into the first receptacle of the adhesive-applying device and made to contact the new adhesive backing retained by the second receptacle to adhere the new backing to the diverter. Optionally, prior to loading the diverter into the first receptacle, the remaining adhesive residue may be removed from the skin-contacting side of the diverter. The new adhesive backing 1610 may comprise a first release liner 1610*a*, a second release liner 1610*c*, and an adhesive layer 1610*b* therebetween. The adhesive layer 1610*b* may comprise multiple layers and may have adhesive properties on both sides, as described above. The first and second release liners may help to protect the adhesive properties of the adhesive layer 1610*b* until it is adhered to a diverter and/or a wearer. In some variations, the adhesive backing 1610 may be in the form of a roll, or may be a segment that has a length corresponding to the length of the sweat-diverting device 1601. The adhesive backing 1610, or one or more of the layers 1610*a*, 1610*b*, and 1610*c*, may have a length that is larger than the length of the sweat-diverting device 1601, which may facilitate its retention within the recess 1612 of the second receptacle 1604.

The first receptacle 1602 may comprise a longitudinal slot 1614 that is sized and shaped to retain a leg of the diverter 1601 (e.g., the leg that does not contact the skin). For example, the slot 1614 may be at an angle (e.g., an acute angle) with respect to the outer surface of the first receptacle 1602 in order to accommodate the angle between the two legs of the diverter. The position of the diverter within the slot 1614 may be secured by any suitable releasable mechanism, for example, by one or more clamps, snaps, and the like. In some variations, the diverter 1601 may have one or more alignment openings and the first receptacle 1602 may have one or more posts that correspond in size and location to the openings on the diverter. The adhesive backing 1610 may be secured within the recess 1612 using similar releasable mechanisms. The locations where the diverter 1601 and the adhesive backing 1610 are secured may correspond to each other when the first receptacle is mated with the second receptacle. Securing the position of the diverter in the first receptacle and the adhesive backing in the second receptacle may help to ensure that the diverter and the adhesive backing remain aligned. Once the adhesive backing 1610 has been secured in the recess 1612, the first release liner 1610*a* may be removed, exposing an adhesive portion (e.g., a PVC or thermoplastic elastomer compatible adhesive). The first receptacle 1602 with a diverter 1601 retained therein may be mated with the recess 1612 of the second receptacle such that the exposed adhesive portion contacts the skin-contacting side of the diverter 1601. In some variations where the first receptacle 1602 is separate from the second receptacle 1604, the first receptacle may be slid into the recess 1612. In other variations where the first receptacle 1602 is coupled to the second receptacle by a hinge (e.g., along the lower edge 1605 of the recess 1612), the first receptacle may be pivoted to rotate into the recess 1612. Optionally, once the first receptacle is seated within the recess of the second receptacle, the first receptacle may be pressed against the second receptacle to help ensure that the adhesive backing 1610 is securely attached to the diverter 1601. After the adhesive backing 1610 has been attached to the diverter 1601, the first receptacle 1602 may be withdrawn from the second receptacle. The second release liner 1610*c* may remain attached to the adhesive layer 1610 (e.g., to a skin-compatible adhesive layer) and be removed before the diverter is applied to a wearer.

Figure 9:
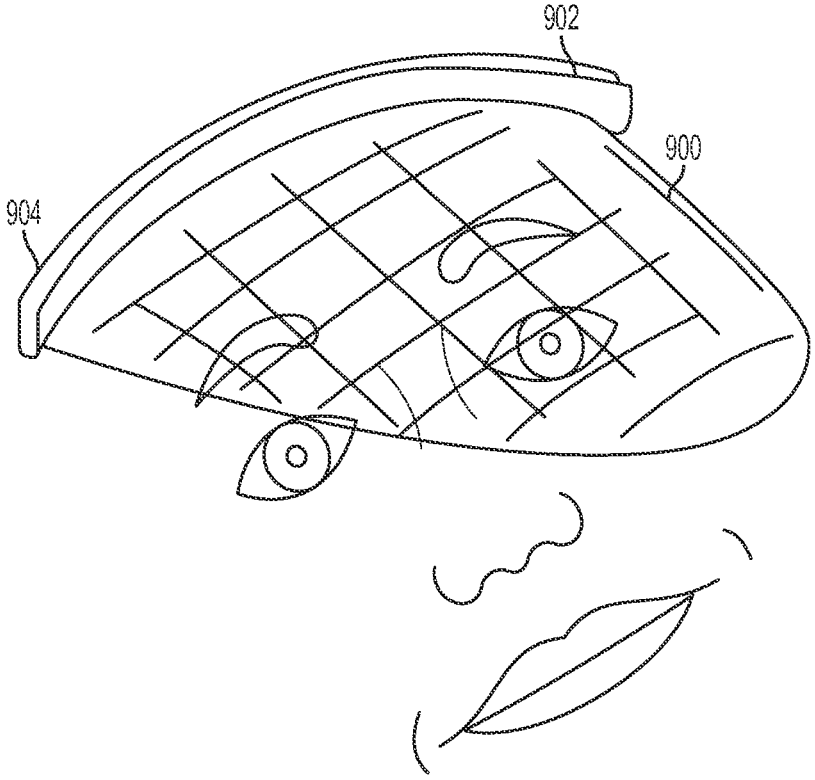
FIG. 9 depicts one variation of an adhesive sweat-diverting device comprising a shade element.
Figure 10A:
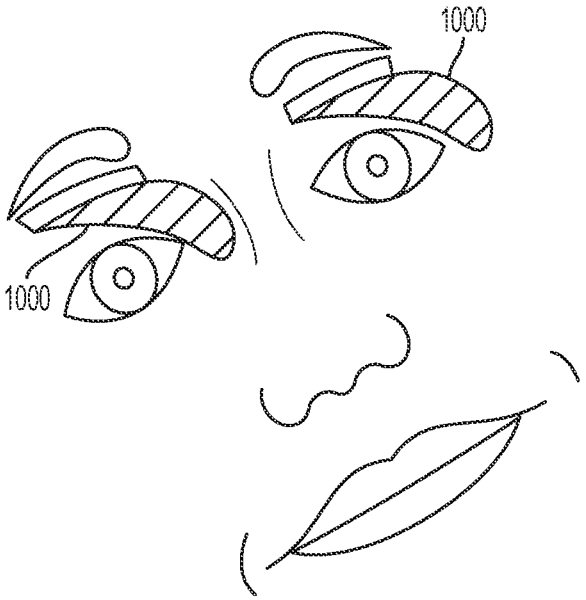
FIGS. 10A-10C depict another variation of an adhesive sweat-diverting device comprising a shade element.
Figure 10B:
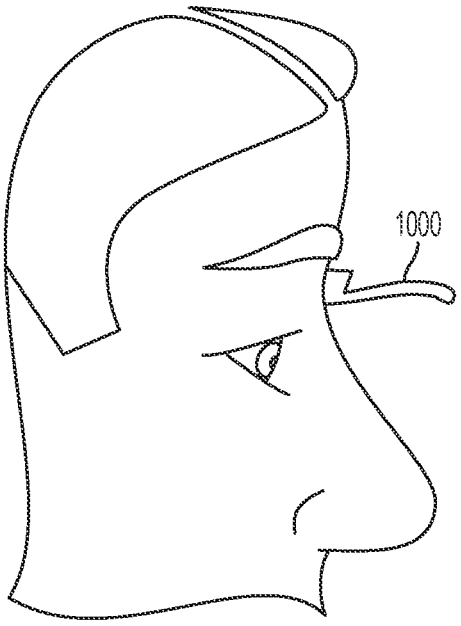
Figure 10C:
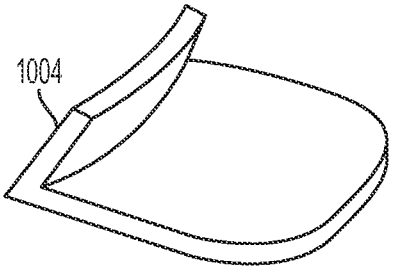

In some embodiments, an adhesive device may be configured to provide shade over the eyes, with or without a sweat-diverter. In some variations, the device is an adhesive sweat-diverting device configured to provide shade to the eyes. Such a device may comprise a shade element which may extend substantially perpendicularly from the face of the wearer and which may create a shade over the eye or eyes, for example, as schematically depicted in FIG. 9 and FIGS. 10A-10C, and FIGS. 12C and 12F. For instance, shade elements (900), (1000), (1207), and (1213) may protrude from the face of the wearer at an angle from about 45 to about 135 degrees. For example, about 45 to about 90 degrees, or about 90 degrees to about 135 degrees. In some variations, the angle is about 90 degrees. In some variations, the angle may be adjusted by the wearer during use (e.g., to accommodate changes in the wearer's position relative to the sun), or the angle may be pre-determined and fixed. Shade elements may be wide enough to shade both eyes (e.g., shade element (900)), or may be wide enough to shade only one eye (e.g., shade element (1000)). The shade elements (1000) of the adhesive sweat-diverting device illustrated in FIGS. 10A-10C may each have a curve that approximates the curvature of the eyes, which may help provide better shading from the sun. The length of the shade elements (900), (1000), (1207), (1213), and (1220) may be any suitable length such that the shadow it creates overlaps with the eye region of the wearer, or it may be adjustable by the wearer by tearing or cutting to a suitable length. The shade elements may be perforated for the purpose of enabling the tearing of the device to a desired length. Adhesive sweat-diverting devices with one or more shade elements may be sized and shaped to adhere to the wearer's skin in any of the positions described previously. For example, an adhesive sweat-diverting device may be positioned above the eyebrows, as shown in FIG. 9. Alternatively, adhesive sweat-diverting devices may be positioned between the eyebrows and the eyes, as shown in FIGS. 10A-10B. In some variations, the adhesive portions may be similar to one or more of the adhesives described above. For example, the adhesive portions (904), (1004) may comprise the entire skin-contacting surface of the device. Such a continuous adhesive region may help ensure that the device is securely attached to the wearer and may create a seal such that sweat does not leak into the wearer's eyes. Sweat-collection and/or sweat-diverting channels, such as sweat-collection channel (902) shown in FIG. 9, may be of any suitable configuration, as described above. For example, sweat-collection channel (902) may have a U-shaped shaped cross-section or a V-shaped cross-section, as depicted and described previously.

Figure 18A:
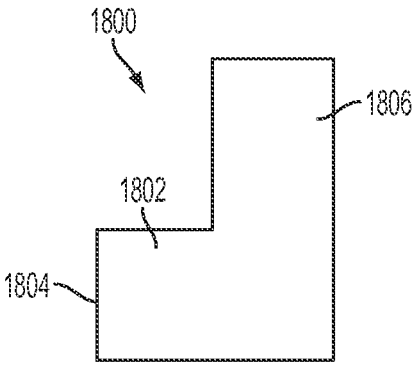
FIG. 18A depicts a side view of one variation of a sweat-diverting device.
Figure 18B:
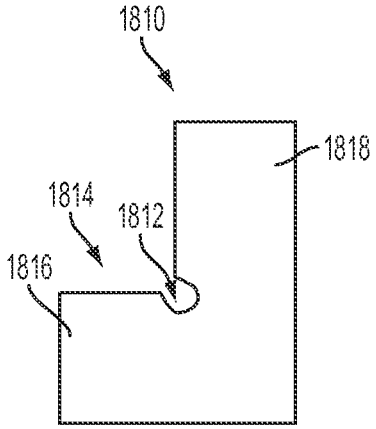
FIG. 18B depicts a side view of another variation of a sweat-diverting device.
Figure 18C:
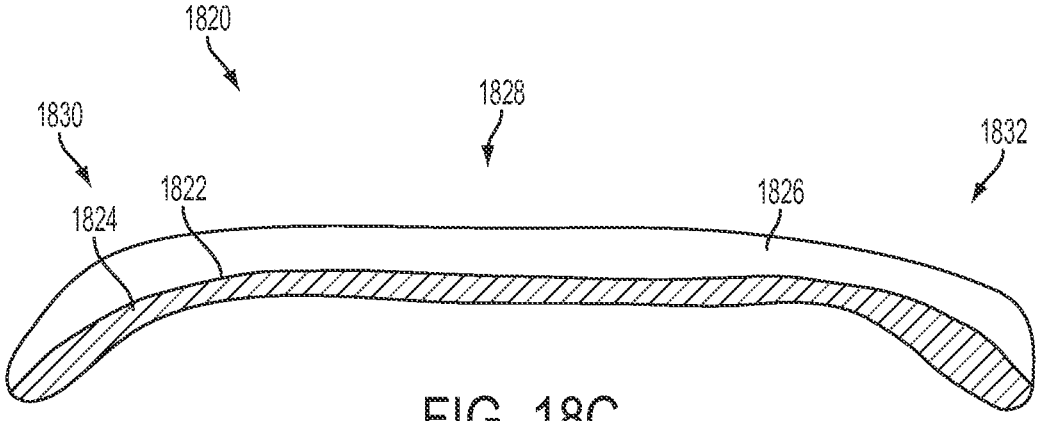
FIG. 18C is a back planar view of either of the sweat-diverting devices of FIGS. 18A and 18B.

Other variations of sweat-diverter devices are depicted in FIGS. 18A-18C. Sweat-diverting devices may have a L-shaped cross-section, with an optional notch or groove along the internal angle of the L-shape. FIG. 18A depicts one variation of a L-shaped sweat-diverting device (1800) comprising a horizontal leg (1802) having a longitudinal skin-contacting surface (1804), and a vertical leg (1806) attached to the horizontal leg at about 90 degrees. The skin-contacting surface (1804) may have a skin-compatible adhesive coating or layer (e.g., such as any of the adhesives described above). A sweat-diverting channel may be formed when the sweat-diverting device (1800) is attached to a wearer's head, such that the wearer's head and the vertical leg (1806) form the vertical walls of the sweat-diverting channel and the horizontal leg (1802) forms the bottom wall of the channel. While the angle between the vertical leg and the horizontal leg may be about 90 degrees, it should be understood that the angle may be from about 1 degree to about 170 degrees, as may be desirable. Optionally, there may be a longitudinal notch or groove (1812) along the junction of the vertical and horizontal legs, which may increase the sweat-collection capacity of the channel (1814). FIG. 18B depicts one variation of a L-shaped sweat-diverting device (1810) comprising a horizontal leg (1816), a vertical leg (1818), and a longitudinal groove (1812) located at the junction of the horizontal and vertical legs. FIG. 18C is a planar view of the skin-contacting side of an L-shaped sweat-diverting device (e.g., the device of FIG. 18A or 18B). The L-shaped sweat diverter (1820) may comprise a horizontal leg (1822) having a skin-contacting surface (1824) and a vertical leg (1826). A sweat-diverting channel is formed between the vertical leg and the skin of the wearer when the diverter is applied to the head. As depicted in FIG. 18C, the middle portion (1828) of the diverter may have a first curvature (or may be substantially straight) and the left portion (1830) and the right portion (1832) of the diverter may be curved with a different curvature from the first curvature. For example, the left and right portions of the diverter may curve more (e.g., have a tighter radius of curvature) than the middle portion. The curvature of the left portion (1830) may be the same or different from the curvature of the right portion (1832). When the diverter is applied to a wearer's head, the additional curvature at the ends of the diverter may help to guide the sweat collected in the channel away from the eyes (e.g., to drip down along the side of the face). Any of the sweat-diverters described herein may have such pre-shaped curves on the left and right side of the device. Alternatively, any of the sweat-diverters described herein may be substantially straight across its length and may not have any pre-shaped curves. Some sweat-diverters may be made of a sufficiently flexible material such that as they are applied to a wearer's head, they can be shaped and/or bent by the wearer and adhered to the skin with curves selected by the wearer. This may allow the wearer to customize the diverter according to the unique curvature of their heads and/or faces.

Such L-shaped sweat-diverting devices may be made of one or more of the materials described above, and/or may be made of a foam (e.g., open or closed cell foam). Examples of foam materials may include polyolefin, polypropylene, polyethylene, polyurethane, PVC, rubber, and the like. In some variations, at least a portion of a sweat-diverting device may be made of an open-cell foam, which may have wicking properties (e.g., for the retention of some sweat or transmission of sweat to the ends of the diverter) and/or may be more compliant than a closed-cell foam of the same material. L-shaped sweat-diverting devices may be manufactured by extrusion and/or rotary die-cutting of foam. In some variations, L-shaped sweat-diverting devices may be made of multiple (e.g., two or more) pieces and/or sheets of foam that are laminated together. The adhesive coating/layer may be co-extruded with the foam, or may be hot melt or sprayed onto the skin-contacting surface. The adhesive coating/layer may also be a tape (e.g., transfer, single-coated, double-coated) that is applied over the skin-contacting surface of the horizontal leg. In some variations, the adhesive may be applied such that it is continuous across the skin-contacting surface or it may be intermittent across the skin-contacting surface.

Figure 19A:
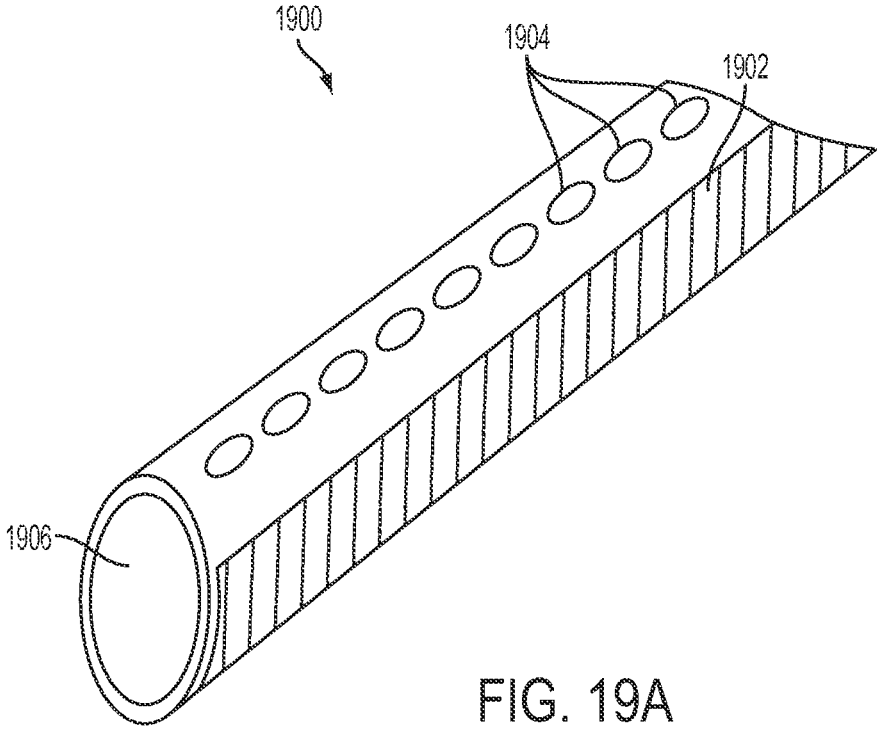
FIG. 19A depicts a perspective view of one variation of a tubular sweat-diverting device.

Any of the sweat-diverting devices described herein may be made of paper-based materials and/or polymer sheet materials. Optionally, any of the sweat-diverting devices described herein may be made of a biodegradable material. Examples of paper-based materials may include coated or uncoated paper or card stock. In some variations, the sweat-diverting devices may be coated with a varnish, shellac, polyethylene, kaolinite, calcium carbonate, Bentonite, talc, chalk and/or china clay. Some coatings, such as chalk and/or china clay, may be bound to the paper with synthetic viscofiers (e.g., styrene-butadiene latexes) and/or natural organic binders (e.g., starch). Any colors, designs, or other indicia may be printed onto the sheet prior to, during, or after assembly. For example, text, graphics, patterns, etc. may be printed onto the surface of the sheet such that when it is assembled and worn, the printed design is visible to others. Examples of designs may include team colors, logos, photographs, brand identification, etc. FIGS. 19A-19D depict additional variations of sweat-diverting devices that may be made of paper-based and/or polymer sheet materials (but may also be made of any other materials, including foam, as may be desirable). FIG. 19A depicts one variation of a tubular sweat-diverting device (1900) comprising a skin-contacting surface (1902) that is coated with an adhesive, one or more apertures or openings (1904) on an upper surface of the device, and a longitudinal channel (1906) extending along the length of the device. The adhesive on the skin-contacting surface may be any adhesive described above. The cross-sectional shape of the tubular sweat-diverting device (1900) may be any shape, e.g., any closed polygon, such as circle, rectangle, square, pentagon, etc. The skin-contacting surface (1902) may be flattened, which may help facilitate apposition of the diverter against a wearer's head. In use, sweat may be collected through the openings (1904) and diverted to the sides of the wearer's head via the longitudinal channel (1906). There may be any number of openings (1904) located longitudinally along the upper surface of the diverter, e.g., 5, 10, 12, 15, 20, 25, 30, 45, 50, etc. In addition to facilitating the collection of sweat, the openings (1904) may also provide a degree of flexibility and bendability of the tubular diverter along its longitudinal length, which may help to improve the apposition of the device to a wearer's head. The number of openings (1904) and the spacing therebetween may be at least partially determined by the degree of flexibility and/or bendability imparted to the device. For example, the number and spacing of openings (1904) may be selected such that the tubular sweat-diverting device is capable of having a radius of curvature of about 0.125 inch to about 10 inches, e.g., from about 0.25 inch to about 10 inches. The tubular sweat-diverting device may be made of a sheet (e.g., paper, polymer) that is rolled into a tube. The two edges of the sheet may be secured by any mechanism (e.g., adhesion, tabs in slots, or other interlocking shapes) to retain the substantially tubular shape.

Figure 19B:
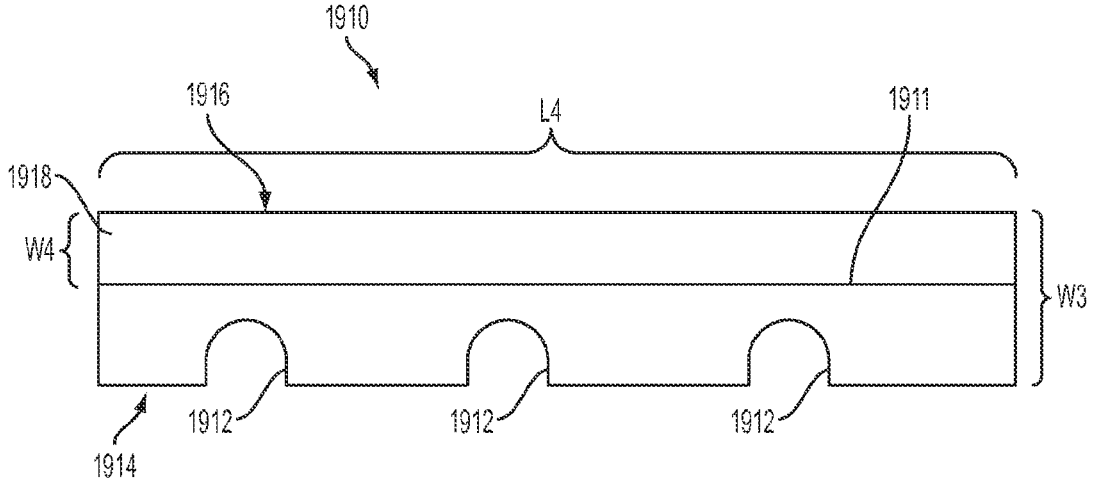
FIG. 19B depicts a flattened planar view of another variation of a sweat-diverting device.

FIG. 19B depicts another variation of a sweat-diverting device comprising a strip that has a plurality of slots or scores along its length. Such slots or scores may help facilitate apposition of the sweat-diverting device to the curvature of a wearer's forehead. Sweat-diverting device (1910) may comprise a plurality of slots or cut-outs (1912) on a lower edge (1914) of the device, where the slots (1912) are arranged longitudinally along the length LA of the device. The upper portion and/or edge (1916) of the device may not be slotted. The non-slotted portion of the device may be a lip (1918) of the sweat-collection channel when attached to a wearer. In some variations, the slots (1912) may only extend partially across the width W3 of the device (e.g., to a midline (1911) of the device (1910)), so that the upper portion of the device is a continuous. For example, the slots may extend 10%, 15%, 20%, 25%, 30%, 40%, 50%, 60%, 70%, 75%, etc. across the width W3 of the device. The width W4 of the lip (1918) of the device (1910) may be 15%, 25%, 30%, 40%, 50%, 70%, 75%, 80%, 85%, 90%, etc. the width W3 of the device. The slots may have any suitable shape, and may be shaped as slits (curved and/or straight), triangular, rectangular, polygonal, etc. In some variations, the slots may be a pattern of repeating cutout shapes and/or slits. Graphics and other indicia may be printed on any of the outward-facing surfaces of the sweat-diverting device (1910), for example, the upper portion/lip (1918).

Figure 19C:
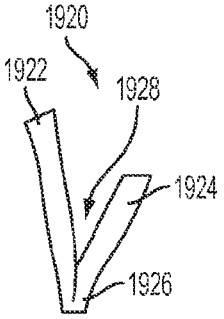
FIG. 19C depicts another variation of a sweat-diverting device.

FIG. 19C depicts another variation of a sweat-diverting device (1920) that may have a shape similar to the sweat-diverting devices described previously (e.g., in FIGS. 14A-14F). The sweat-diverting device (1920) may comprise a first leg (1922) with a skin-contacting surface having an adhesive, a second leg (1924), and a base portion (1926) at a juncture between the first and second legs that forms a sweat-collecting channel (1928). The base portion (1926) may be thicker than either of the first and second legs. The sweat-diverting device (1920) may be made of a longitudinal strip of a sheet material (e.g., paper, polymer, foam, etc.) that is folded longitudinally. The crease of the fold may be secured by applying an adhesive. In some variations, the two surfaces of the sheet on either side of the fold may be "pinched" together and secured to form a base that has a thickness that is greater than either of the legs. In other variations the device may be comprised of two separate sheets of material that may be joined at the base as described above.

Figure 19D:
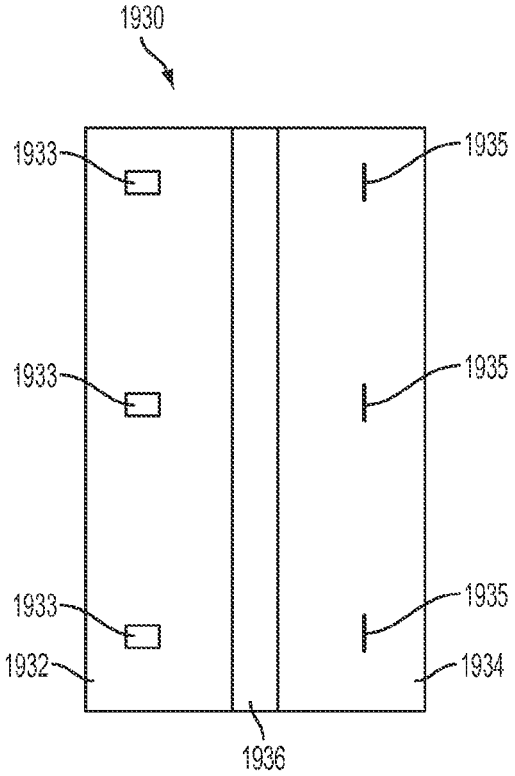
FIG. 19D depicts a flattened planar view of a sweat-diverting device.

FIG. 19D depicts another variation of a sweat-diverting device (1930) comprising a first longitudinal sheet or strip (1932), a second longitudinal sheet or strip (1934), and a film (1936) that longitudinally joins the first (1932) and second strips (1934). The first strip (1932) may have a skin-contacting surface (which is opposite to the side that is shown) that has a skin-compatible adhesive. When the device (1930) is folded along the film (1936), a sweat-collection channel is formed in the space between the first and second strips. The first and second strips may be folded such that they form an acute angle therebetween (e.g. from about 5 degrees to about 85 degrees, e.g., 45 degrees). To help ensure that a certain space is maintained between the first and second strip and/or that an acute angle is maintained therebetween, the first strip (1932) may have a tab (1933) and the second strip may have a slot (1935) such that when the device (1930) is folded along the film (1936), the tab (1933) engages with the slot (1935) such that a space (e.g., about the length of the tab (1933)) is maintained between the first strip (1932) and the second strip (1934). There may be a plurality of such corresponding tabs and slots along the length of the device (1930), as may be desirable to maintain the space and/or angle between the first and second strips. For example, there may be one pair, two pairs, three pairs, four pairs, five pairs, six pairs, etc. of tabs and slots along the length of the sweat-diverting device. All the tabs may have the same length, or may have different lengths, which lengths are at least partially determined by the desired space and/or angle between the first and second strips at a particular longitudinal location. Alternatively or additionally, the second strip may have a longitudinal fold such that the outer edge of the second strip contacts the first strip, similar to the configuration of the sweat-diverting devices described above and depicted in FIGS. 2M and 2N. Once the desired separation between the first and second strips is attained, the outer edge of the second strip may be attached to the first strip (e.g., using tabs and slots, and/or adhesives, etc.). Such means of configuring the device may be accomplished in manufacturing or performed (at least in part) by the user.

Figure 19E:
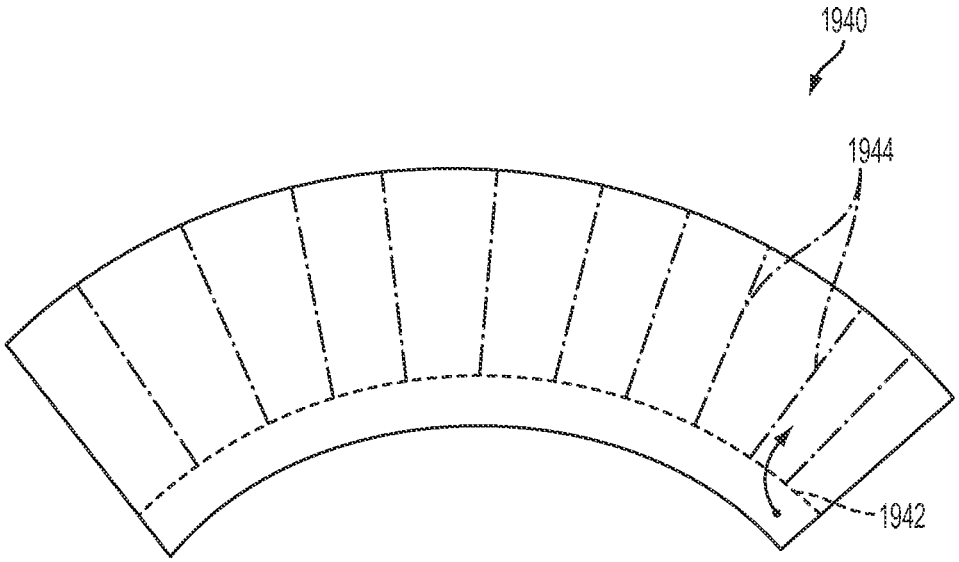
FIGS. 19E-19I depict a planar view of and steps for making one variation of a sun-shade device or a sweat-diverting device. Cut lines are indicated by broken dashed lines, fold lines are indicated by dashed lines, and hidden edges are indicated by dotted lines.
Figure 19F:
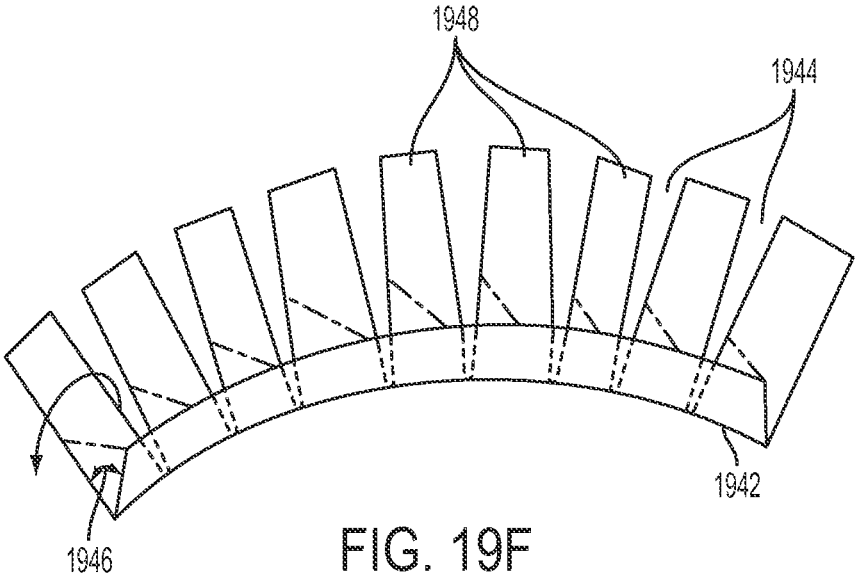
Figure 19G:
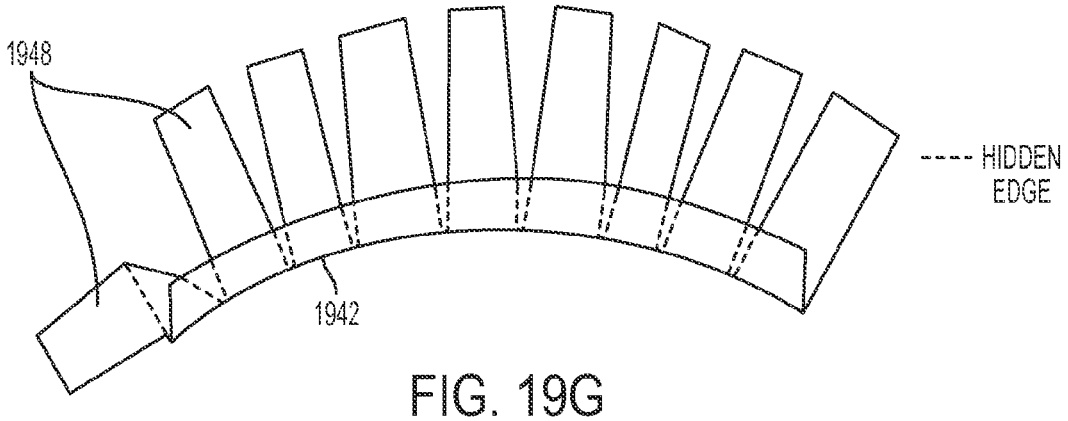
Figure 19H:
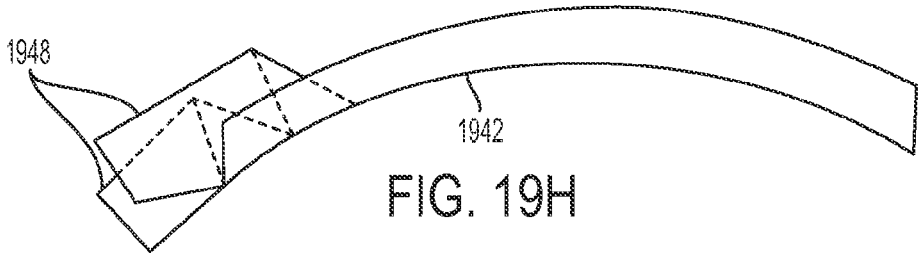
Figure 19I:
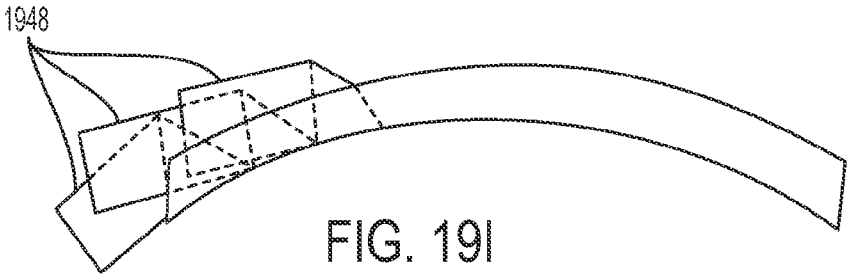

FIGS. 19E-19I depict another variation of a sweat-diverting or sun-shading device (1940) that may be constructed from a flat sheet material by cutting and folding. Cut lines are indicated by dashed and dotted lines, fold lines are indicated by dashed lines, and hidden edges are indicated by dotted lines. In some variations, a flat sheet may be folded along a curved line substantially parallel to a similarly curved edge, such as is depicted in FIG. 19E. Such a fold may be ⅛ inch to 1 inch from such similarly curved edge, and the radius of curvature of a fold (1942) may be similar to the approximate curvature of a forehead (e.g. from 1" to 18") and such radius may be constant or may vary along the length of the device. An area between the edge and fold of such device may have an adhesive coating in either a continuous or non-continuous pattern on the inward side of the area between a fold and a substantially parallel inner edge of a device. As depicted in FIG. 19F, a plurality of cuts (1944) may be made such that the cuts run from the fold (1942) along the dotted and dashed lines in a direction substantially perpendicular to the fold (1942). The cuts (1944) may be spaced from ⅛" to 1" apart, such that the series of folds (1942) may each lie substantially in a straight line where the angle (1946) formed by each of the folds is approximately 90 degrees, and the series of straight folds may result in a generally curved overall shape. A plurality of strips (1948) lie between the cuts, and such strips may be folded as indicated by the arrows at an acute angle such that the portion distal to the fold covers one of the cuts adjacent to the corresponding strip. FIGS. 19G-19I depict the folds for the first three strips (1948), which may be repeated for all the strips (other strips are not shown for clarity). After all the folds for all the strips have been completed, they may be adhered in place to maintain the folds to create the shade element of a sun-shading device. Similar folds may be repeated on the shade element to create a channel for sweat-collection.

In other variations, adhesive sweat-diverting devices may not have a discrete sweat-collection or sweat-diverting channel, but may have one or more shade elements that are curved such that sweat is diverted away from the wearer, and across the contour of upper surface of the shade element(s). Such devices are depicted in FIGS. 11A-C and FIG. 12A, FIG. 12B, FIG. 12 D, and FIG. 12E. As with all the devices described here, these devices may or may not have a continuous adhesive seal to the skin of the wearer. For example, the devices described here may have only intermittent adhesive portions. Since such adhesive shade devices do not circumscribe the head and only extend across some or all of the wearer's face, these adhesive shade devices may be positioned closer to the eyes (e.g., just above the eyebrows, and/or between the eyebrows and the eyes, etc.) if desirable. This may help to provide better shading from the sun. The device depicted in FIGS. 11A-11C has a width such that shade is provided to both eyes, but in other variations, the device may have a smaller width that is suitable for providing shade to just one eye and used in pairs, as shown in FIG. 10A. While these devices have been described and depicted as providing shade to the eyes, it should be understood that these devices may also be configured to shade other parts of the body, as may be desirable. For example, these devices may be configured to provide shade to the ears, nose, back of the neck, or any region of the arms or legs. These devices may also be used to shield and/or provide shade to sensitive regions of the body, for example, any cuts, scrapes, rashes, burns, areas of light sensitivity, etc.

Figure 11A:
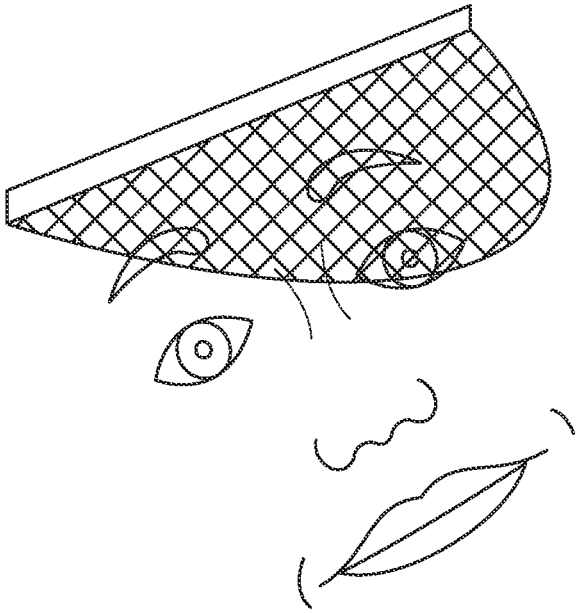
FIGS. 11A-11C depict one example of an adhesive shade device.
Figure 11B:
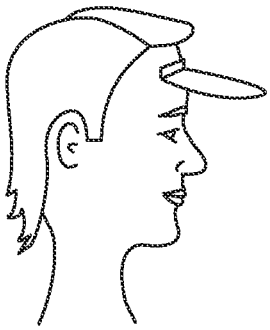
Figure 11C:
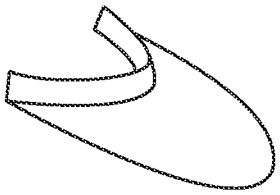
Figure 12A:
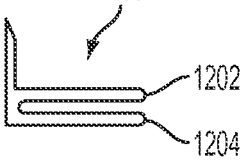
FIGS. 12A-12F depict additional illustrative variations of adhesive shade devices.
Figure 12B:
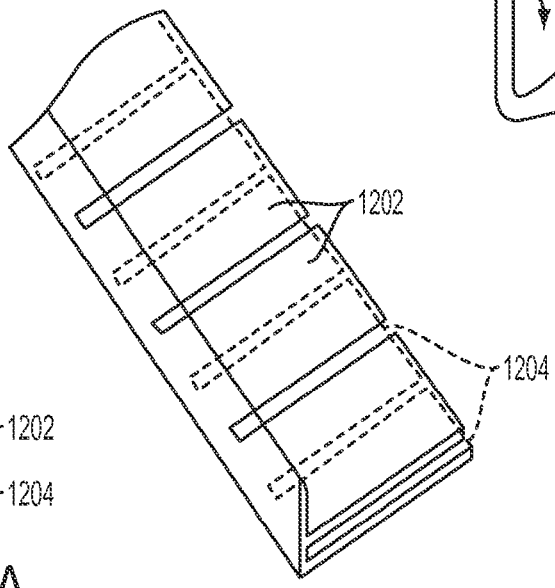
Figure 12C:
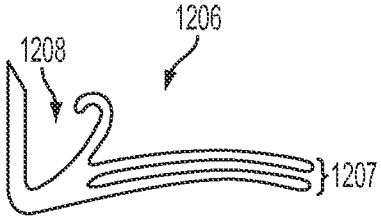
Figure 12D:
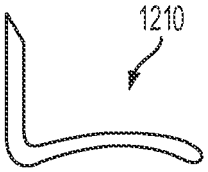
Figure 12E:
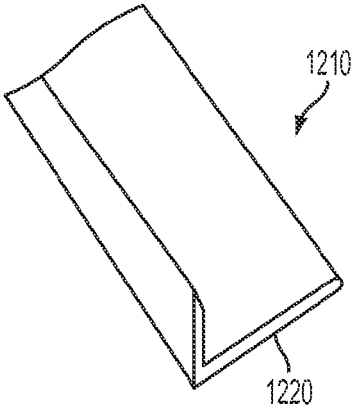
Figure 12F:
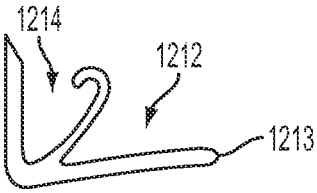

While FIGS. 11A-11C depict one variation of an adhesive sun-shade device substantially in the form of a visor, other variations of adhesive sun-shade devices are shown in FIGS. 12A-12F. In contrast to the visor of the sun-shade device of FIGS. 11A-11C (which may be long enough to shade a wearer's entire face), the device of FIGS. 12A-12C has a relatively lower profile, where the length of the shading portion may not be long enough to shade a wearer's face, but may protrude far enough to shade a wearer's eyes. FIG. 12A-12C depict a two-layered sun shade (1200) having off-set slots or tabs in each layer. The slots or tabs may or may not be made from one or more perforations or slots in the sun shading portions, and these portions may or may not be made from the same material or have the same thickness, width, or orientation. FIG. 12A shows a cross-sectional view of shade (1200), having two layers of off-set tabs (1202, 1204) and FIG. 12B provides a perspective view of shade (1200). In this variation, having off-set tabs (1202, 1204) may help the device conform more easily to the wearer's head without deformation. FIG. 12C provides a cross-sectional view of a two-layered sun shade (1206), here including a sweat diverting channel (1208). FIGS. 12D-12F show a single-layered sun shade embodiment. FIG. 12D shows a cross-sectional view of sun shade (1210), having one layer, FIG. 12E shows a perspective view of sun shade (1210), and FIG. 12F shows a cross-sectional view of sun-shade (1212) having a diverter channel (1214).

Figure 20:
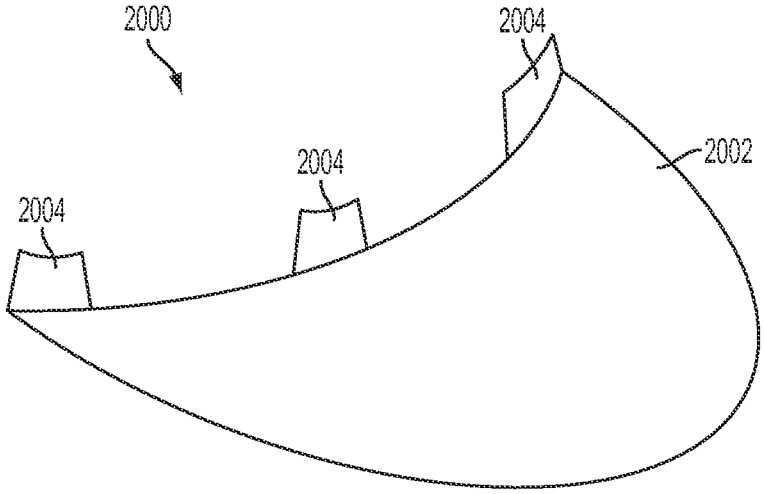
FIG. 20 is a perspective view of an adhesive sun-shade device.

The adhesive portion of any of the sun-shade devices described herein may be a single continuous band across the length of the device, or may be a series of adhesive segments. For example, as depicted in FIG. 20, a sun-shade device (2000) may comprise a shade component (2002) that may be attached to a wearer via a plurality of adhesive tabs (2004) along the length of the shade component. There may be any number of adhesive tabs, for example, 2, 3, 4, 5, 6, 7, 8, 9, 10, 12, 14, 20, 24, 25, etc. tabs. In some variations a sunshade may comprise a reusable sun-blocking portion and a disposable skin-adhering portion. For example the skin-adhering portion may be a single strip having several shorter tabs with skin-compatible adhesive on a first side and a means of attaching to the reusable sun-blocking on a second side, wherein the attachment means may engage with and retain the reusable sun-blocking portion. Such attachment means may be any suitable connector, such as hook and loop closure, snaps, friction-fit, and/or adhesive.

Figure 17A:
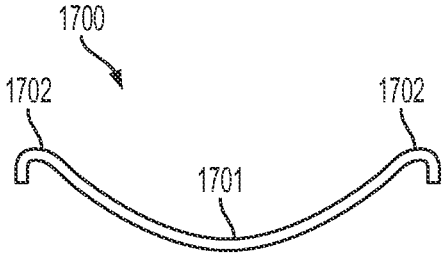
FIG. 17A is a schematic depiction of one variation of a sweat-diverting device having hooked ends.
Figure 17B:
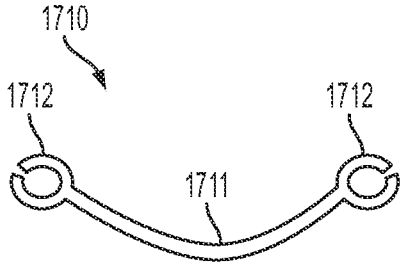
FIG. 17B is a schematic depiction of another variation of a sweat-diverting device having looped ends.
Figure 17C:
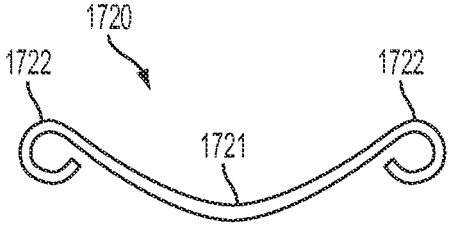
FIG. 17C is a schematic depiction of another variation of a sweat-diverting device having looped ends.

Described herein are kits that may comprise any of the sweat-diverting devices described above. In some variations, a kit may comprise a sweat-diverting device and any type of eye wear (e.g., glasses, goggles, etc.), where the sweat-diverting device is configured to attach to at least a portion of the top rim of the glasses. For example, a first leg of the sweat-diverting device may comprise an adhesive backing for attaching to the skin of the wearer, and the sweat-collecting channel of the diverter may be positioned over the top rim of a pair of glasses or goggles. Alternatively, the sweat-collecting channel may be integrated with the top rim or lenses of the glasses such that sweat collected within the channel is diverted along the top rim or lenses to the sides of the glasses (e.g., the top rim may have a longitudinal groove or channel therealong). In some variations, a kit may comprise a sweat-diverting device and a helmet (e.g., an industrial helmet or an athletic/sports helmet), where the sweat-diverting device is configured to attach to at least a portion of the helmet (e.g., an edge or rim of the helmet and/or the helmet straps). For example, the right and left ends of the sweat-diverting device may contact with the straps of the helmet such that sweat captured in the device is diverted to the straps and guided down the wearer's chin and/or sides of their head. In some variations, the right and left ends of the sweat-diverting device may be curved, looped, or hooked, which may help the device contact and/or engage with the helmet straps during the physical activity (FIGS. 17A-17C). The curved, looped, or hooked portions 1702, 1712, 1722 may be made of the same material (e.g., PVC, thermoplastic elastomer) as the sweat-diverting portion (e.g., the channel) 1701, 1711, 1721 of the device, 1700, 1710, 1720, or may be made of a different material (e.g., a wicking and/or absorbent material). Diverting the collected sweat to the straps may help to ensure that the sweat does not drip across unwanted areas of the face. In some variations, the helmet strap may be made of (and/or may have attached to it) a wicking material which may help draw the collected sweat in the diverter away from wearer's face. Alternatively or additionally, the right and/or left ends of the sweat-diverting device may be made of an absorbent and/or wicking material to help guide the sweat to the helmet strap. In still other variations, a kit may comprise a sweat-diverting device and a sweat band made of absorbent material, where the sweat-diverting device may collect and divert any excess sweat that is not absorbed by the sweat band. Any of these kits may optionally include an adhesive-applying device (e.g., such as the one described above) and one or more additional adhesive backing strips or rolls.

Figure 21A:
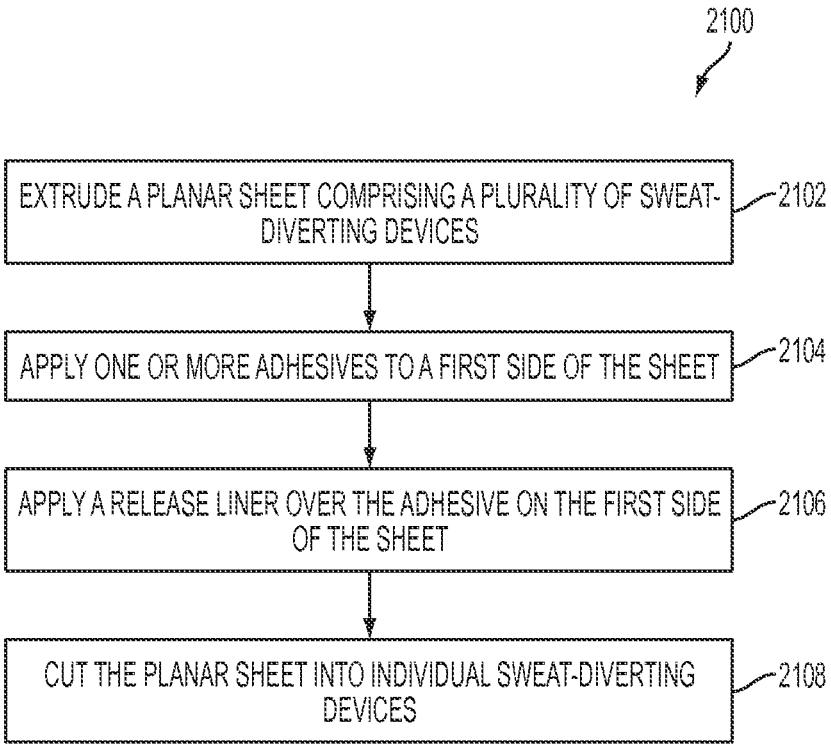
FIG. 21A is a flowchart depiction of method for manufacturing any of the sweat-diverting devices described herein.
Figure 21B:
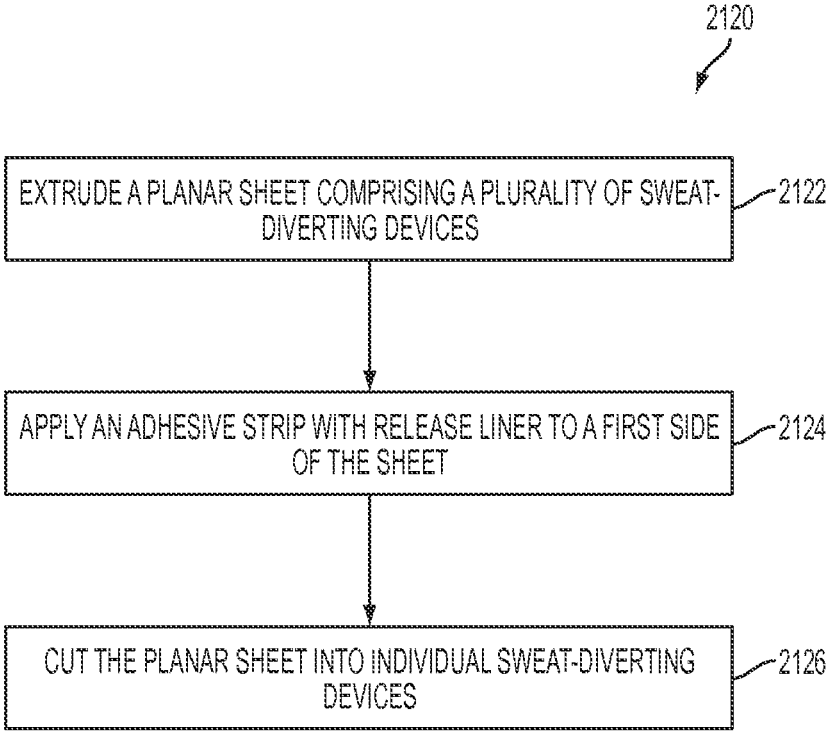
FIG. 21B is a flowchart depiction of another method for manufacturing any of the sweat-diverting devices described herein.

Described below are methods for manufacturing any of the sweat-diverting devices described above. FIGS. 21A and 21B depict flowchart representations of variations of manufacturing methods that may help to expedite the production of a plurality of sweat-diverting devices simultaneously. As depicted in FIG. 21A, method 2100 may comprise extruding

2102 a planar sheet comprising a plurality of sweat-diverting devices, applying 2104 one or more adhesives over the side of the sheet that contains the skin-contacting surfaces of the sweat-diverting devices, applying 2106 a release liner over the one or more adhesives, and then cutting 2108 the planar sheet into individual sweat-diverting devices, which may or may not be fully separated from each other. Another method 2120 is depicted in FIG. 21B. Method 2120 may comprise extruding 2122 a planar sheet comprising a plurality of sweat-diverting devices, applying 2124 an adhesive strip that has a release liner over the side of the sheet that contains the skin-contacting surfaces of the sweat-diverting devices, and then cutting 2126 the planar sheet into individual sweat-diverting devices, which may or may not be fully separated from each other. The material of the planar sheet may comprise one or more of the materials described above. A planar sheet may comprise anywhere from 1-500 sweat-diverting devices (e.g., 1, 2, 3, 4, 5, 6, 7, 8, 9, 10, 11, 12, 20, 40, 50, 75, 100, 150, 250, 300, 400, 500, etc.). In some variations, the sheet may comprise a first side and a second side opposite the first side. The first side corresponds to the skin-contacting surfaces of the first longitudinal walls or legs of the sweat-diverting devices. The second side has a plurality of longitudinal flanges that correspond to the second longitudinal walls or legs of the sweat-diverting devices. Cuts made along or between the plurality of longitudinal flanges may separate discrete sweat-diverting devices.

Some methods of manufacturing may include additional steps for printing a design on the sweat-diverting device and/or release liner. For example, a design may be provided on the sweat-diverting device during the extrusion (e.g., where the design is part of the extrusion die) or at any time after the device is extruded (e.g., before, during, or after the application of the adhesive and/or release liner and/or cutting step). The design may include graphical representations (e.g., any non-alphanumeric symbols, pictures or drawings, logos, shapes, etc.) or text (e.g., any alphanumeric symbols). The design may be located on a front-facing side of the sweat-diverting device, such as the outer surfaces of the first and second legs, such that the design is visible when the sweat-diverting device is worn. For example, the design may be located on a top portion of the front-facing side of the first leg (the leg that contacts the wearer's skin).

Alternatively or additionally, a design may be provided on a release liner of the sweat-diverting device. The design may be applied to the release liner (which may be clear or opaque) before the release liner is attached to the adhesive or after the release liner is attached to the adhesive. Alternatively or additionally, the design may be applied to the release liner after it has been attached to the sweat-diverting device. In some variations, the release liner of an adhesive strip may be printed with a graphical design before the strip is applied to the sweat-diverting device (e.g., the graphical design may be applied during the manufacture of the adhesive strip, and/or before step 2124 of method 2120). In some variations, an adhesive strip with a release liner without a design may be applied to the sweat-diverting device, after which the release liner is removed and replaced with a second release liner that has a graphical design prior to the cutting step.

Figure 22A:
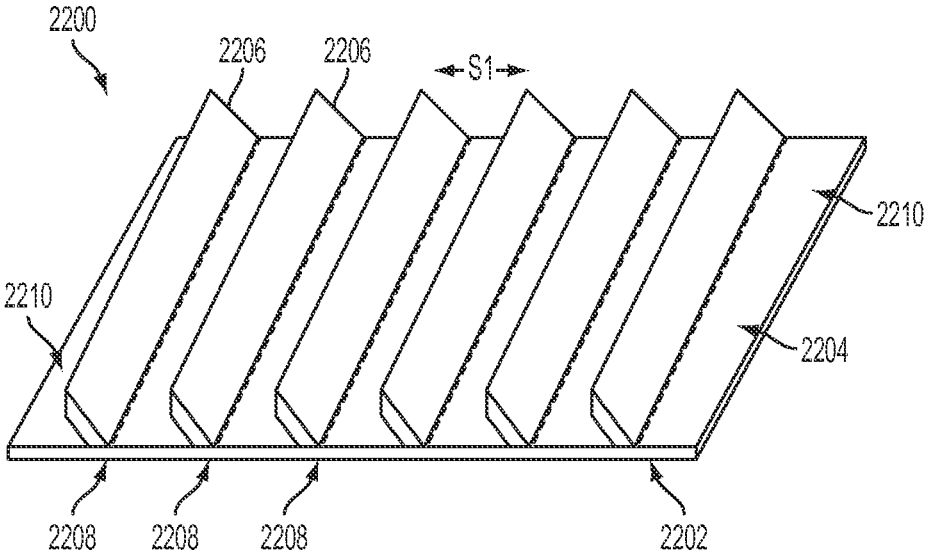
FIGS. 22A and 22B schematically depict a perspective view and an end view, respectively, of one variation of a sheet comprising a plurality of sweat-diverting devices that may be used in the method depicted in FIG. 21.
Figure 22B:
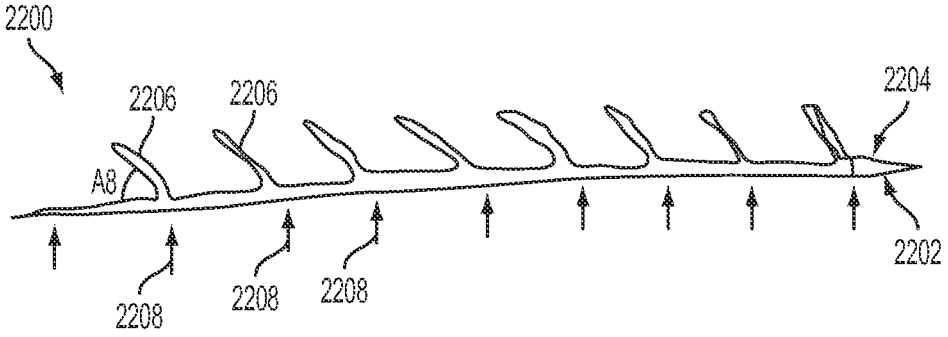

The longitudinal flanges on the second side of the planar sheet may be arranged in any suitable fashion such that cutting the sheet parallel to the longitudinal flanges separates out an individual sweat-diverting device. One variation of a planar sheet is schematically depicted in FIGS. 22A-B (FIG. 22A is a side perspective view and FIG. 22B is a side view). The planar sheet 2200 comprises a first side 2202 and a second side 2204, where the second side has a plurality of longitudinal flanges 2206. Each of the longitudinal flanges 2206 corresponds to the second longitudinal wall or leg of a sweat-diverting device. The longitudinal flanges 2206 may be extruded such that they form an angle A8 with respect to the plane of the sheet. The angle A8 may correspond to the angle between the first and second legs or longitudinal walls of a sweat-diverting device, as described above, and may vary from 1 degree to about 89 degrees, e.g., about 45 degrees. The separation S1 between the juncture of each of the longitudinal flanges 2206 to the sheet may approximate the length of the first leg or longitudinal wall of a sweat-diverting device, and may be from about 0.1 in to about 0.4 in, e.g., about 0.313 in. Longitudinal cuts made along each of the flanges (i.e., on the side with the angle complementary to angle A8) indicated by the arrows 2208 would separate out individual sweat-diverting devices. The end portions 2210 of the sheet 2200 may be trimmed as needed.

Figure 22C:
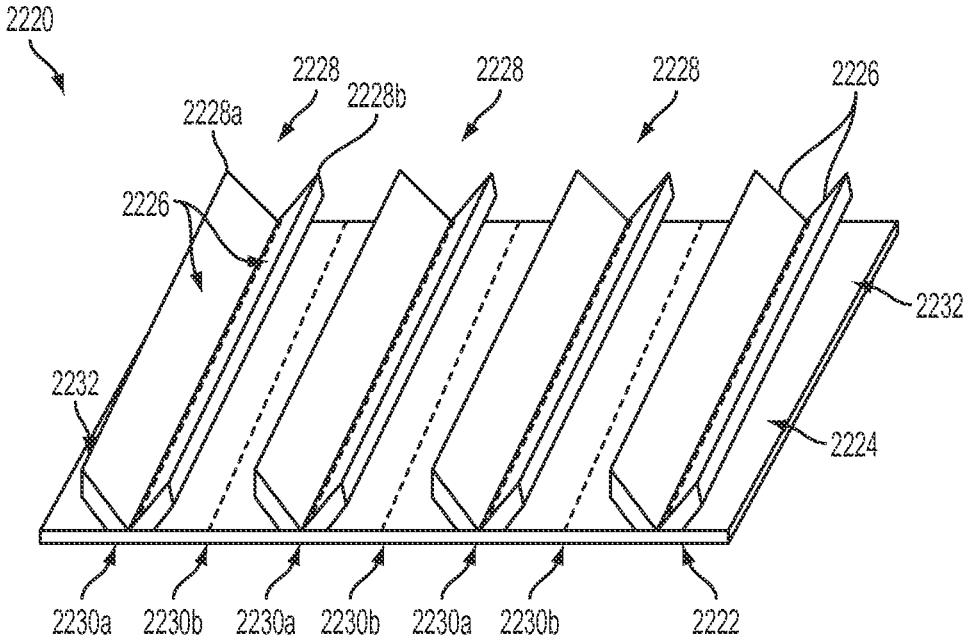
FIGS. 22C and 22D schematically depict a perspective view and an end view, respectively, of another variation of a sheet comprising a plurality of sweat-diverting devices that may be used in the methods depicted in FIGS. 21A-21B.
Figure 22D:
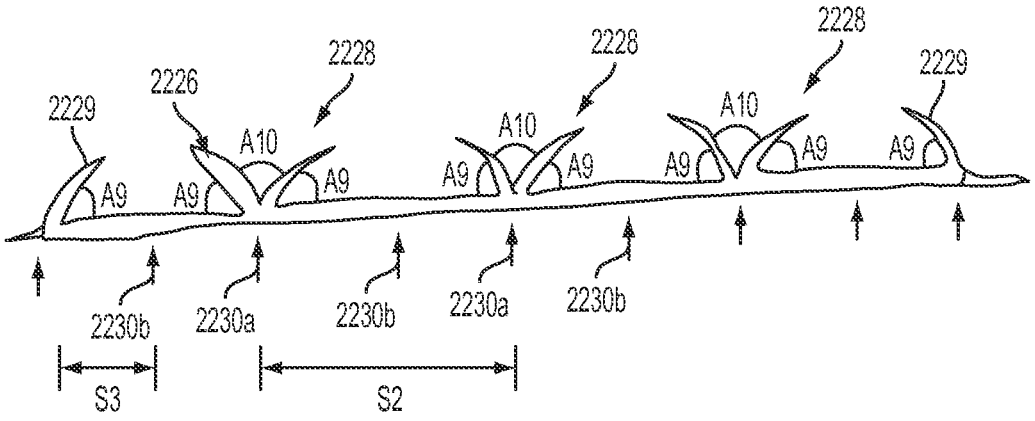

Another variation of a planar sheet is schematically depicted in FIGS. 22C-D (FIG. 22C is a side perspective view and FIG. 22D is a side view). The planar sheet 2220 comprises a first side 2222 and a second side 2224, where the second side has a plurality of longitudinal flanges 2226. Each of the longitudinal flanges 2226 corresponds to the second longitudinal wall or leg of a sweat-diverting device. At least some of the longitudinal flanges 2226 may be arranged in pairs 2228, such that the flanges of each pair 2228*a*, 2228*b* abut each other where they contact the second side of the sheet. The longitudinal flanges 2226 may be extruded such that they each form an angle A9 with respect to the plane of the sheet. In the case of a pair of longitudinal flanges, each of the flanges may have the same angle A9, but oriented in opposite directions from each other. The angle A9 may correspond to the angle between the first and second legs or longitudinal walls of a sweat-diverting device, as described above, and may vary from 1 degree to about 89 degrees, e.g., about 45 degrees. The angle A10 between a pair of longitudinal flanges may be (180 degrees−2*(angle A9)), and may vary from about 2 degrees to about 178 degrees, e.g., about 90 degrees. The separation S2 between the junctures of each of the pairs 2228 on the sheet may be approximately twice the length of the first leg or longitudinal wall of a sweat-diverting device, and may be from about 0.2 in to about 0.8 in, e.g., about 0.626 in. Where a longitudinal flange is not part of a pair (e.g., flange 2229), a cut may be made on the side of the angle A9 (e.g., the side facing the acute angle) that has a separation S3 away from the junction of that flange to the sheet that approximates the length of the first leg, where S3 may be from about 0.1 in to about 0.4 in, e.g., about 0.313 in. Longitudinal cuts made along the flanges indicated by the arrows 2230*a*, 2230*b* would separate out individual sweat-diverting devices. Some of the longitudinal cuts 2230*a* may be made between the juncture of a pair of flanges, while other cuts 2230*b* may be made at a separation S3 away from a longitudinal flange (e.g., an unpaired flange). For example, some cuts 2230*b* may be made about halfway between two pairs of flanges. The ends 2232 of the sheet 2220 may be trimmed as needed.

In some variations (e.g., the method 2100), after extrusion of the planar sheets, but before the sheet is cut into individual sweat-diverting devices, an adhesive may be applied to the first side of the sheet, followed by a release liner to protect the adhesive until use. One or more adhesives of different types and properties may be applied, and may optionally be layered, as previously described and depicted in FIGS. 15A-B. Rollers, presses and any suitable converting machinery may be used to apply one or more adhesives and/or release liners to the sheet. In some variations (e.g., the method 2120), an adhesive strip with a release liner may be applied to the first side of the sheet, so that a separate step for applying a release liner is not needed. However, in some variations, and adhesive may not be applied to the sheet during the manufacturing process, but is instead applied by the wearer just prior to use of the device (e.g., as described and depicted above in FIG. 16 or FIG. 8)

Cutting or trimming of the planar sheet into individual sweat-diverting devices after the application of the adhesive and release liner may be performed by rotary cutters, slicers and any suitable converting machinery may be used to cut or trim the sheet. In some variations, cutting the planar sheet may comprise mounting the planar sheet on a guiding plate that has grooves that correspond to each of the longitudinal flanges, so that the sheet may be properly positioned as it is being cut. Alternatively or additionally, cutting the planar sheet may comprise guiding the sheet as it is fed into the cutting machinery. The location of the blades in the cutting machinery may be adjusted at the beginning of the manufacturing process to correspond to the locations on the planar sheet indicated by the arrows in FIGS. 22A-22D. Any or all of the rollers, presses and other converting machinery used to extrude and/or apply the adhesive to the sheet may be configured to register the sheet for cutting in the desired location by the cutting machinery. The depth of the cuts may extend through the thickness of the planar sheet, adhesive and release liner (e.g., a "through-cut"), and/or may extend through the thickness of the planar sheet and the adhesive, while not cutting into the release liner, or only partially through the release liner (e.g., a "kiss-cut"). The depths of the cuts made on a planar sheet may include some cuts that extend through the thickness of the planar sheet, adhesive and release liner and some cuts that cut through the thickness of the planar sheet and adhesive, but only a part of release liner (or not through the release liner at all). For example, where it may be desired to include a certain number X of sweat-diverting devices in a single package (e.g., where X is 2, 3, 4, 5, 6, 7, 8, 9, 10, etc.), through-cuts may be made to separate the sheets into groups having X number of devices, and kiss-cuts may be made within each group to separate the individual sweat-diverting devices from each other, but still keep them coupled together on a continuous release liner. In some variations, the release liner may be continuously intact, while in other variations, the release liner may be partially cut through such that a sweat-diverting device may be stripped/torn off from the rest of the group prior to use. More generally, the planar sheets may be cut in any way that may keep the individual sweat-diverting devices loosely coupled (e.g., adhered, or on a single release liner) to each other such that they may be easily removed one at a time prior to use. Alternatively, the planar sheets may have through-cuts separating each of the sweat-diverting devices so that individual sweat-diverting devices are not coupled to each other via any adhesives or release liner. Additionally, the planar sheets may have through-cuts separating each of the sweat-diverting devices so that individual sweat diverting devices are not coupled to each other by any means other than the exposed thickness of adhesive of adjacent sweat-diverting devices, holding them together but allowing them to be easily separated from one another.

After the individual sweat-diverting devices are made, they may be packaged into flat packs or tubes. The number of devices in a package may vary, as may be desirable (e.g., 1-7 or 1-10 or 1-12 or 1-20 or 1-50 per package). As described above, the cutting method may vary depending on the number of devices desired in a package. For example, if it is desired to have six sweat-diverting devices in a flat package, the cutting machinery may be configured to provide through-cuts to divide the planar sheet into groups of six sweat-diverting devices, with kiss-cuts between each of the six devices so that they are coupled via a single release liner. If it is desired to have six sweat-diverting devices in a tubular package, the cutting machinery may be configured to provide through-cuts to completely separate each individual sweat-diverting device. Alternatively, sweat-diverting devices that are coupled to each other via a single release liner may be rolled up and inserted into a tubular package.

While the sweat-diverting devices and shade devices described above are depicted and described as being applied over the eyes and/or at different locations on a wearer's head or face, it should be understood that these devices may be adapted to be applied elsewhere on a wearer's body to collect and/or divert different types of fluid. For example, sweat-diverting devices may be adapted for placement in the under-arm regions of the body, at the wrists or ankles to prevent the flow of sweat to the hands or feet, below the eyes (e.g., for the collection of tears), etc. Sun shade devices may be adapted for placement behind the head over the neck, over one or both ears, etc. Fluid diverting and sun-shading devices like those described herein may also be adapted to veterinary or companion animal use for like indications.

The invention claimed is:

1. An adhesive sweat-diverting device configured to be worn above an eyebrow of a wearer without circumscribing the head, comprising:

a base;

a first leg joined to the base, wherein the first leg has a skin-contacting surface comprising an adhesive, and further comprises a length and a thickness; and a second leg joined to the base to form an acute angle at a junction of the first leg, the second leg, and the base, the acute angle defining a sweat-diverting channel therebetween, and wherein the second leg further comprises a length and a thickness; and wherein at least a portion of the base has a thickness that is greater than the thickness of the first and second legs such that the acute angle is maintained and a ratio of the thickness of the base to the thickness of either the first and second legs is from about 1.1:1 to about 15:1.

2. The device of claim 1, wherein the acute angle is from about 30 degrees to about 60 degrees.

3. The device of claim 1, wherein the base is tapered.

4. The device of claim 1, wherein the first and second legs are made of a first material and the base is made of a second material, wherein the second material is more rigid than the first material.

5. The device of claim 4, wherein a portion of the first and second legs are made of the second material.

6. The device of claim 1, wherein the ratio of the thickness of the base to the thickness of either of the first and second legs is from about 1.5:1 to about 15:1.

7. The device of claim 1, wherein the ratio of the thickness of the base to the thickness of either of the first and second legs is from about 1.5:1 to about 5:1.

8. The device of claim 1, wherein the junction of the first leg, the second leg, and the base form a juncture, and wherein a thickness of a portion of the legs at the juncture is greater than a thickness of a remaining portion of the legs.

9. The device of claim 1, wherein a portion of the first and/or second leg is tapered.

10. The device of claim 1, wherein the second leg has one or more bends along its length.

11. The device of claim 1, wherein a tip portion of the second leg has a bend.

12. The device of claim 1, wherein the adhesive is removable.

13. The device of claim 1, wherein at least a portion of the first and second legs are made of an absorbent material.

14. The device of claim 1, wherein at least a portion of the base is stiffer than the first leg and the second leg.

15. The device of claim 1, wherein at least a portion of the second leg is stiffer than the first leg.

16. The device of claim 1, wherein at least a portion of the first leg is stiffer than the second leg.

17. The device of claim 1, wherein at least a portion of the base has a width that is greater than the thickness of the first and second legs.

18. An adhesive sweat-diverting device configured to be worn above an eyebrow of a wearer without circumscribing the head, comprising:

a base;

a first leg joined to the base, wherein the first leg has a skin-contacting surface comprising an adhesive;

a second leg joined to the base such that a sweat-diverting channel is formed in a space between the first and second legs; and wherein at least a portion of the base has a thickness that is greater than a thickness of the first and second legs such that the space between the first and second legs is maintained and the ratio of the thickness of the base to the thickness of either the first and second legs is from about 1.1:1 to about 15:1.

* * * * *